US010391803B2

(12) United States Patent
Kikuchi et al.

(10) Patent No.: US 10,391,803 B2
(45) Date of Patent: Aug. 27, 2019

(54) IMAGE RECORDING PAPER MEDIUM, METHOD FOR MANUFACTURING SAME, AND IMAGE RECORDING METHOD

(71) Applicant: FUJIFILM Corporation, Tokyo (JP)

(72) Inventors: Wataru Kikuchi, Ashigarakami-gun (JP); Yuji Yoshida, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/938,421

(22) Filed: Mar. 28, 2018

(65) Prior Publication Data

US 2018/0215185 A1 Aug. 2, 2018

Related U.S. Application Data

(63) Continuation of application No. PCT/JP2016/078197, filed on Sep. 26, 2016.

(30) Foreign Application Priority Data

Sep. 30, 2015 (JP) ..... 2015-195277

(51) Int. Cl.

| | |
|---|---|
| ***B41M 5/00*** | (2006.01) |
| ***B41M 5/50*** | (2006.01) |
| ***B41M 5/52*** | (2006.01) |
| ***D21H 27/00*** | (2006.01) |
| ***D21H 19/56*** | (2006.01) |
| ***D21H 19/12*** | (2006.01) |
| ***D21H 21/16*** | (2006.01) |

(52) U.S. Cl.

CPC ..... *B41M 5/502* (2013.01); *B41M 5/0023* (2013.01); *B41M 5/50* (2013.01); *B41M 5/52* (2013.01); *B41M 5/5218* (2013.01); *B41M 5/5245* (2013.01); *B41M 5/5254* (2013.01); *B41M 5/5263* (2013.01); *D21H 19/12* (2013.01); *D21H 19/56* (2013.01); *D21H 21/16* (2013.01); *D21H 27/00* (2013.01); *B41M 5/0047* (2013.01)

(58) Field of Classification Search

CPC ..... B41M 5/5218; B41M 5/5254; B41M 5/5263; B41M 5/0023

See application file for complete search history.

(56) References Cited

U.S. PATENT DOCUMENTS

| | | | | |
|---|---|---|---|---|
| 9,889,695 | B2 * | 2/2018 | Kikuchi | B41M 5/0017 |
| 2005/0008795 | A1 | 1/2005 | Dungworth et al. | |
| 2008/0187680 | A1 | 8/2008 | Kawakami et al. | |

(Continued)

FOREIGN PATENT DOCUMENTS

| | | | |
|---|---|---|---|
| EP | 1 644 198 | B1 | 4/2007 |
| EP | 3 202 584 | A1 | 8/2017 |

(Continued)

OTHER PUBLICATIONS

Communication dated Sep. 17, 2018, from European Patent Office in counterpart application No. 16851410.7.

International Preliminary Report on Patentability, dated Apr. 3, 2018 from the International Bureau in counterpart International application No. PCT/JP2016/078197.

Written Opinion, dated Oct. 25, 2016 from the International Bureau in counterpart International application No. PCT/JP2016/078197.

International Search Report, dated Oct. 25, 2016 from the International Bureau in counterpart International application No. PCT/JP2016/078197.

*Primary Examiner* — Betelhem Shewareged

(74) *Attorney, Agent, or Firm* — Sughrue Mion, PLLC

(57) ABSTRACT

An image recording paper medium containing a resin having a constitutional unit represented by General Formula (1) and a constitutional unit represented by General Formula (2-1) and/or a constitutional unit represented by General Formula (2-2), in which in the resin, a content of the constitutional unit represented by General Formula (1) is 30% to 96% by mass, and a total content of the constitutional unit represented by General Formula (2-1) and the constitutional unit represented by General Formula (2-2) is 4% to 70% by mass. Also provided are a manufacturing method of the image recording paper medium and an image recording method including the manufacturing method:

General Formula (1)

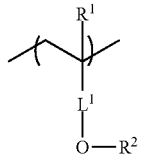

General Formula (2-1)

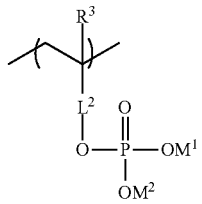

General Formula (2-2)

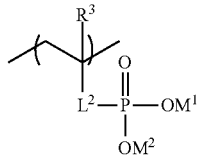

where $R^1$, $L^1$, $R^2$, $R^3$, $L^2$, $M^1$ and $M^2$ are as defined herein.

13 Claims, No Drawings

(56) References Cited

U.S. PATENT DOCUMENTS

| | | | | |
|---|---|---|---|---|
| 2009/0088521 | A1* | 4/2009 | Hosokawa | C09D 11/326 524/558 |
| 2009/0130312 | A1 | 5/2009 | Ono et al. | |
| 2011/0308752 | A1 | 12/2011 | Esser et al. | |

FOREIGN PATENT DOCUMENTS

| | | | |
|---|---|---|---|
| JP | 7-133394 | A | 5/1995 |
| JP | 2000-141873 | A | 5/2000 |
| JP | 2002-220794 | A | 8/2002 |
| JP | 2008-230216 | A | 10/2008 |
| JP | 2009-500187 | A | 1/2009 |
| JP | 2009-125948 | A | 6/2009 |
| JP | 2009-226598 | A | 10/2009 |
| JP | 2012-516950 | A | 7/2012 |
| WO | 2015/114070 | A1 | 8/2015 |

* cited by examiner

IMAGE RECORDING PAPER MEDIUM, METHOD FOR MANUFACTURING SAME, AND IMAGE RECORDING METHOD

CROSS-REFERENCE TO RELATED APPLICATIONS

This application is a Continuation of PCT International Application No. PCT/JP2016/078197 filed on Sep. 26, 2016, which claims priority under 35 U.S.C. § 119 (a) to Japanese Patent Application No. JP2015-195277 filed on Sep. 30, 2015. Each of the above applications is hereby expressly incorporated by reference, in its entirety, into the present application.

BACKGROUND OF THE INVENTION

1. Field of the Invention

The present invention relates to an image recording paper medium, a method for manufacturing the same, and an image recording method.

2. Description of the Related Art

As image recording methods for forming an image on a recording medium such as paper based on an image data signal, there are recording methods such as an electrophotographic method, sublimation-type and melting-type thermal transfer methods, and an ink jet method.

In the ink jet recording method, a printing plate is not required, and an image is directly formed on a recording medium by jetting an ink only to an image forming portion. Therefore, in this method, the ink can be efficiently used, and the running cost is low. Furthermore, a printing device used in the ink jet recording method is relatively cheaper than a printer used in the related art, can be downsized, and causes little noise. In this way, the ink jet recording method has various advantageous compared to other image recording methods.

In a case where an image is recorded on a recording medium by the ink jet recording method, the moisture in an aqueous ink permeates the recording medium. It is known that the permeating moisture cleaves hydrogen bonds of cellulose constituting a pulp layer of the recording medium, the cleaved hydrogen bonds are recombined after drying, and this leads to a phenomenon (curling or cockling) in which the recording medium is deformed.

In order to prevent the deformation of the recording medium, a method of adding an anti-curl agent such as a saccharide to an ink, a method of forcibly preventing the curling or cockling by using a paper pressing mechanism of a transport portion, and the like have been suggested. However, none of these methods has succeeded in sufficiently preventing the deformation of the recording medium.

JP2009-125948A describes that in a case where a recording medium has a structure in which base paper, a first layer containing a binder, and a second layer containing a white pigment and an acid are laminated, and water absorbing properties of the first layer and the second layer are made fall into a specific range, it is possible to obtain a recording medium which is prevented from experiencing paper deformation such as curling or cockling, bronzing, and color mixing even in a case where an image is formed at a high speed.

Furthermore, JP2009-226598A describes that in a case where a blocking layer containing resin particles having an SP value of equal to or greater than 9.5 is formed on a recording medium, the occurrence of curling is inhibited, and an image having high scratch resistance and reproducibility can be recorded.

SUMMARY OF THE INVENTION

An object of the present invention is to provide an image recording paper medium which is a paper medium for image recording containing a water-insoluble resin, in which due to a moisture barrier function of the water-insoluble resin, the deformation of the paper medium that occurs after an image is formed using an aqueous ink is effectively inhibited, and a degree of gloss of the formed image is excellent. Another object of the present invention is to provide a method for manufacturing the image recording paper medium.

Furthermore, still another object of the present invention is to provide an image recording method which makes it possible to effectively inhibit the deformation of a paper medium that occurs after an image is formed using an aqueous ink, and to form an image having an excellent degree of gloss.

In order to achieve the aforementioned objects, the inventors of the present invention repeated an intensive examination. As a result, the inventors obtained knowledge that water-insoluble fine resin particles, which are formed of a resin having a constitutional unit that has a specific structure having a hydrophobic group and a constitutional unit that has a specific structure having a phosphoric acid group or a salt thereof or having a phosphonic acid group or a salt thereof at a specific quantitative ratio, exhibit excellent dispersibility in an aqueous medium. The inventors also obtained knowledge that even though a paper medium is coated with an aqueous dispersion of the fine resin particles, the aqueous dispersion does not easily permeate the interior of the paper medium, and knowledge that on the surface of the paper medium or in the vicinity of the surface of the paper medium, it is possible to form a layer containing the resin constituting the fine resin particles without causing the deformation of the paper medium. Furthermore, the inventors of the present invention obtained knowledge that in a case where an image is formed on the paper medium containing the aforementioned resin by using an aqueous ink, the moisture in the ink is effectively prevented from permeating the interior of the paper medium, the occurrence of cockling can be inhibited to a high extent, and a degree of gloss of the formed image is excellent.

Based on the aforementioned knowledge, the inventors of the present invention further repeated the examination and accomplished the present invention.

The aforementioned objects of the present invention were achieved by the following means.

[1] An image recording paper medium comprising a resin having a constitutional unit represented by General Formula (1) and a constitutional unit represented by General Formula (2-1) and/or a constitutional unit represented by General Formula (2-2), in which in the resin, a content of the constitutional unit represented by General Formula (1) is 30% to 96% by mass, and a total content of the constitutional unit represented by General Formula (2-1) and the constitutional unit represented by General Formula (2-2) is 4% to 70% by mass.

General Formula (1)

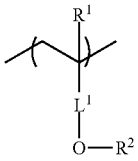

General Formula (2-1)

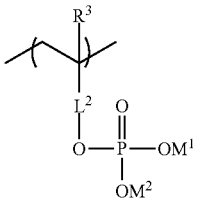

General Formula (2-2)

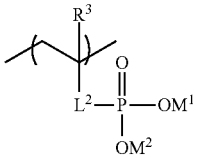

In General Formula (1), $R^1$ represents a hydrogen atom or methyl. $L^1$ represents a divalent linking group having 1 to 5 carbon atoms. $R^2$ represents an alkyl group having 4 to 24 carbon atoms or an aryl group having 6 to 24 carbon atoms.

In General Formulae (2-1) and (2-2), $R^3$ represents a hydrogen atom or methyl. $L^2$ represents a single bond or a divalent linking group having 1 to 30 carbon atoms. $M^1$ and $M^2$ each represent a hydrogen ion or a cation.

[2] The image recording paper medium described in [1], in which in the resin, a ratio of a content Y (% by mass) of the constitutional unit represented by General Formula (1) to a total content X (% by mass) of the constitutional unit represented by General Formula (2-1) and the constitutional unit represented by General Formula (2-2) satisfies $4 \leq Y/X \leq 15$.

[3] The image recording paper medium described in [1] or [2], in which the resin has a constitutional unit represented by General Formula (3).

General Formula (3)

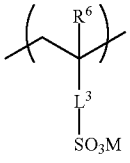

In General Formula (3), $R^6$ represents a hydrogen atom or methyl. $L^3$ represents a divalent linking group. M represents a hydrogen ion or a cation.

[4] The image recording paper medium described in [3], in which in the resin, a content of the constitutional unit represented by General Formula (3) is 3% to 20% by mass.

[5] The image recording paper medium described in [3] or [4], in which in the resin, a ratio of the content Y (% by mass) of the constitutional unit represented by General Formula (1) to a content Z (% by mass) of the constitutional unit represented by General Formula (3) satisfies $5 \leq Y/Z \leq 12$.

[6] The image recording paper medium described in any one of [1] to [5], in which a content of the resin is 0.006 to 5 g/m$^2$.

[7] The image recording paper medium described in any one of [1] to [7], further comprising a coating layer containing calcium carbonate, in which the resin is contained on the coating layer and/or in the coating layer.

[8] A method for manufacturing an image recording paper medium, comprising coating a paper medium with a dispersion obtained by dispersing fine resin particles, which are formed of a resin having a constitutional unit represented by General Formula (1) and a constitutional unit represented by General Formula (2-1) and/or a constitutional unit represented by General Formula (2-2), in an aqueous medium, in which in the resin, a content of the constitutional unit represented by General Formula (1) is 30% to 96% by mass, and a total content of the constitutional unit represented by General Formula (2-1) and the constitutional unit represented by General Formula (2-2) is 4% to 70% by mass.

General Formula (1)

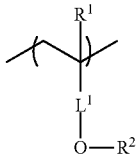

General Formula (2-1)

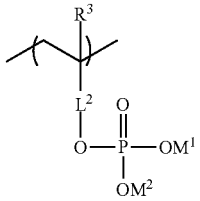

General Formula (2-2)

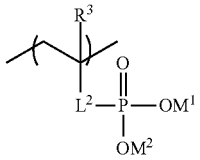

In General Formula (1), $R^1$ represents a hydrogen atom or methyl. $L^1$ represents a divalent linking group having 1 to 5 carbon atoms. $R^2$ represents an alkyl group having 4 to 24 carbon atoms or an aryl group having 6 to 24 carbon atoms.

In General Formulae (2-1) and (2-2), $R^3$ represents a hydrogen atom or methyl. $L^2$ represents a single bond or a divalent linking group having 1 to 30 carbon atoms. $M^1$ and $M^2$ each represent a hydrogen ion or a cation.

[9] The manufacturing method described in [8], in which in the resin, a ratio of a content Y (% by mass) of the constitutional unit represented by General Formula (1) to a total content X (% by mass) of the constitutional unit represented by General Formula (2-1) and the constitutional unit represented by General Formula (2-2) satisfies $4 \leq Y/X \leq 15$.

[10] The manufacturing method described in [8] or [9], in which the resin has a constitutional unit represented by General Formula (3).

General Formula (3)

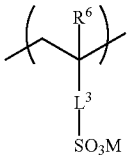

In General Formula (3), $R^6$ represents a hydrogen atom or methyl. $L^3$ represents a divalent linking group. M represents a hydrogen ion or a cation.

[11] The manufacturing method described in [10], in which in the resin, a content of the constitutional unit represented by General Formula (3) is 3% to 20% by mass.

[12] The manufacturing method described in [10] or [11], in which in the resin, a ratio of the content Y (% by mass) of the constitutional unit represented by General Formula (1) to a content Z (% by mass) of the constitutional unit represented by General Formula (3) satisfies $5 \leq Y/Z \leq 12$.

[13] The manufacturing method described in any one of [10] to [12], in which the paper medium has a coating layer containing calcium carbonate, and the coating of the paper medium with the dispersion is coating of the coating layer of the paper medium with the dispersion.

[14] The manufacturing method described in any one of [8] to [13], in which a volume average particle size of the fine resin particles is 0.001 to 1 μm.

[15] An image recording method comprising a step of obtaining an image recording paper medium by the manufacturing method described in any one of [8] to [14], and a step of forming an image by jetting an aqueous ink by using an ink jet method to a surface of the obtained image recording paper medium, the surface being coated with the dispersion.

In the present specification, in a case where there is a plurality of substituents or linking groups (hereinafter referred to as substituents and the like) represented by specific references or formulae or in a case where a plurality of substituents and the like are simultaneously specified, unless otherwise specified, each of the substituents and the like may be the same as or different from each other. The same shall be applied in a case where the number of substituents and the like is specified. Furthermore, in the present specification, a resin may have a plurality of kinds of constitutional units represented by the same general formula.

In the present specification, in a case where the number of carbon atoms in a certain group is specified, the number of carbon atoms means the total number of carbon atoms in the group. That is, in a case where the group additionally has a substituent, the number of carbon atoms includes the number of carbon atoms in the substituent.

In the present specification, a range of numerical values represented using "to" means a range which includes the numerical values listed before and after "to" as a lower limit and an upper limit.

In the image recording paper medium of the present invention, the deformation of the paper medium that occurs after an image is formed using an aqueous ink is effectively inhibited, and the formed image has an excellent degree of gloss. Furthermore, according to the method for manufacturing an image recording paper medium of the present invention, the aforementioned image recording paper medium of the present invention can be obtained. In addition, according to the image recording method of the present invention, it is possible to effectively inhibit the deformation of a paper medium that occurs after an image is formed using an aqueous ink, and to form an image having an excellent degree of gloss.

The aforementioned characteristics and advantages of the present invention and other characteristics and advantages of the present invention will be more clarified by the following description with reference to the attached drawings as appropriate.

DESCRIPTION OF THE PREFERRED EMBODIMENTS

[Image Recording Paper Medium]

The image recording paper medium of the present invention contains a resin having a constitutional unit represented by General Formula (1) and a constitutional unit represented by General Formula (2-1) and/or a constitutional unit represented by General Formula (2-2). The resin may exist in the image recording paper medium in the form of a film or in the form of fine resin particles. Some of the fine resin particles may be in a state of being fused with each other. Particularly, it is preferable that the resin exists in the image recording medium in the form of a uniform film. In order for the resin to effectively perform a moisture barrier function, it is preferable that the resin exists on the surface layer of the image recording paper medium. In the present specification, "surface layer" refers to a region from the surface of the image recording paper medium (in the present specification, in a case where the term "surface" is simply mentioned, it means an image recording surface) to a portion 0.01 to 5 μm deep below the surface. The surface layer may be constituted with a single layer or plural layers.

Furthermore, in the present specification, in a case where the sentence "resin exists in the surface layer" appears, the resin only needs to exist in the surface layer and does not need to exist in the surface of the image recording paper medium (that is, the uppermost surface of the surface layer). That is, in the present specification, in a case where the sentence "resin exists in the surface layer" or "resin is contained in the surface layer" appears, the resin may exist in the uppermost surface of the image recording paper medium or exist in a state of permeating deeper into the paper medium from the uppermost surface of the surface layer. In this case, as long as the resin exists (is contained) in the surface layer, a portion of the resin may exist in a state of permeating deeper into the paper medium from the surface layer.

General Formula (1)

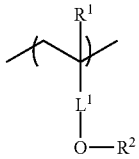

In General Formula (1), $R^1$ represents a hydrogen atom or methyl, and is preferably methyl.

$L^1$ represents a divalent linking group having 1 to 5 carbon atoms. The number of carbon atoms in $L^1$ is preferably 1 to 3, more preferably 1 or 2, and even more preferably 1. Examples of preferable aspects of the linking group which can be adopted as $L^1$ include —C(=O)—, —C(=O)$OCH_2CH_2$—, and —C(=O)$OCH_2CH_2OCH_2CH_2$—. Among these, —C(=O)— is more preferable. In —C(=O)

$OCH_2CH_2$— and —C(=O)$OCH_2CH_2OCH_2CH_2$—, it is preferable that a carbonyl group is linked to a main chain side of the constitutional unit represented by General Formula (1).

$R^2$ represents an alkyl group having 4 to 24 carbon atoms or an aryl group having 6 to 24 carbon atoms.

In a case where $R^2$ is an alkyl group, from the viewpoint of effectively reducing the wettability of the paper medium by the hydrophobicity of the alkyl group and from the viewpoint of synthesis reproducibility, the number of carbon atoms in the alkyl group is preferably 4 to 22, more preferably 4 to 20, and even more preferably 4 to 18. In a case where $R^2$ is an alkyl group, and the number of carbon atoms in the alkyl group is within the aforementioned preferable range, the dispersibility of the resin in water can be improved. Therefore, in a case where an aqueous dispersion of fine resin particles is applied onto the paper medium as will be described later such that the resin is incorporated into the paper medium, it is possible to more homogeneously and more efficiently incorporate the resin into the paper medium. In the present specification, "alkyl group" includes a cycloalkyl group in meaning. In the present specification, an alkyl group may be linear or branched.

Examples of the alkyl group which can be adopted as $R^2$ include substituted methyl, substituted ethyl, substituted propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, methylpentyl, methylhexyl, methylheptyl, methyloctyl, methylnonyl, methylundecyl, methylheptadecyl, ethylhexyl, ethylhexadecyl, methyloctadecyl, propylpentadecyl, hexyldecyl, octyldodecyl, heptylundecyl, cyclopentyl, cyclohexyl, cycloheptyl, cyclooctyl, and isobornyl.

Among these, n-butyl, sec-butyl, tert-butyl, iso-butyl, n-pentyl, iso-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl, iso-dodecyl, n-tridecyl, iso-tridecyl, n-tetradecyl, iso-tetradecyl, n-pentadecyl, iso-pentadecyl, n-hexadecyl, iso-hexadecyl, n-heptadecyl, iso-heptadecyl, n-octadecyl, iso-octadecyl, 2-ethylhexyl, benzyl, or isobornyl is preferable.

The alkyl group which can be adopted as $R^2$ is preferably unsubstituted or has an aryl group (preferably naphthyl or phenyl and more preferably phenyl) as a substituent. Furthermore, the substituent in the substituted methyl, the substituted ethyl, and the substituted propyl described above is preferably an aryl group (preferably naphthyl or phenyl and more preferably phenyl).

In a case where $R^2$ is an aryl group, from the viewpoint of effectively reducing the wettability of the paper medium by the hydrophobicity of the aryl group and from the viewpoint of synthesis reproducibility, the number of carbon atoms in the aryl group is preferably 6 to 20, more preferably 6 to 18, even more preferably 6 to 15, still more preferably 6 to 12, and yet more preferably 6 to 10. In a case where $R^2$ is an aryl group, and the number of carbon atoms in the aryl group is within the aforementioned preferable range, the dispersibility of the resin in water can be improved. Therefore, in a case where an aqueous dispersion of fine resin particles is applied onto the paper medium as will be described later such that the resin is incorporated into the paper medium, it is possible to more homogeneously and more efficiently incorporate the resin into the paper medium.

Specific examples of the aryl group preferably include naphthyl or phenyl, and more preferably include phenyl. The aryl group which can be adopted as $R^2$ may have a substituent, and as the substituent, a group is preferable which is selected from an alkyl group (preferably an alkyl group having 1 to 10 carbon atoms, more preferably an alkyl group having 1 to 6 carbon atoms, and even more preferably an alkyl group having 1 to 4 carbon atoms), a hydroxyl group, an amino group, and a halogen atom. It is preferable that the aryl group which can be adopted as $R^2$ is unsubstituted.

In the constitutional unit represented by General Formula (1), $R^2$ has high hydrophobicity, and the constitutional unit is necessary for making the resin insoluble in water. In the image recording paper medium, the constitutional unit plays a role of preventing moisture from permeating the paper medium by reducing wettability of water.

A monomer from which the constitutional unit represented by General Formula (1) is derived is not particularly limited as long as the monomer can form the constitutional unit represented by General Formula (1) by polymerization. Examples of those preferable as the monomer include (meth)acrylic acid esters such as n-butyl (meth)acrylate, iso-butyl (meth)acrylate, tert-butyl (meth)acrylate, n-hexyl (meth)acrylate, cyclohexyl (meth)acrylate, phenyl (meth) acrylate, benzyl (meth)acrylate, octyl (meth)acrylate, 2-ethylhexyl (meth)acrylate, decyl (meth)acrylate, isodecyl (meth)acrylate, dodecyl (meth)acrylate, stearyl (meth)acrylate, and isobornyl (meth)acrylate. In the present specification, "(meth)acrylic acid" means a methacrylic acid or an acrylic acid. The above (meth)acrylic acid esters are preferably methacrylic acid esters.

In the aforementioned resin, a content of the constitutional unit represented by General Formula (1) is 30% to 96% by mass, preferably 30% to 90% by mass, more preferably 40% to 90% by mass, even more preferably 50% to 88% by mass, still more preferably 55% to 85% by mass, and yet more preferably 60% to 85% by mass.

General Formula (2-1)

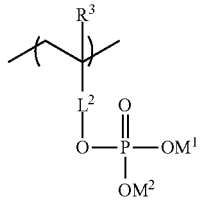

General Formula (2-2)

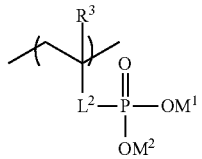

In General Formulae (2-1) and (2-2), $R^3$ represents a hydrogen atom or methyl, and is preferably methyl.

$L^2$ represents a single bond or a divalent linking group having 1 to 30 carbon atoms. In a case where $L^2$ is a divalent linking group having 1 to 30 carbon atoms, the number of carbon atoms in the divalent linking group is preferably 1 to 26, more preferably 1 to 24, even more preferably 1 to 20, and still more preferably 1 to 15.

In a case where $L^2$ is a divalent linking group having 1 to 30 carbon atoms, examples of preferable structures thereof include a structure represented by General Formula (2a) or (2b).

General Formula (2a)

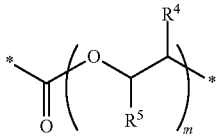

General Formula (2b)

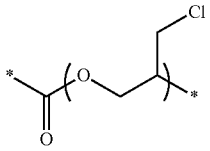

In General Formulae (2a) and (2b), * represents a linking site.

$R^4$ and $R^5$ each represent a hydrogen atom or methyl. It is preferable that at least any one of $R^4$ or $R^5$ is a hydrogen atom. It is more preferable that $R^5$ is a hydrogen atom.

m is 1 to 10, preferably 1 to 8, more preferably 1 to 6, even more preferably 1 to 4, still more preferably 1 to 3, yet more preferably 1 or 2, and particularly preferably 1.

In the General Formulae (2a) and (2b), between two linking sites *, the linking site * on the left side (carbonyl side) is preferably linked to a main chain side in the constitutional units represented by General Formulae (2-1) and (2-2), and the linking site * on the right side is preferably linked to a phosphoric acid group or a salt of the phosphoric acid group of General Formulae (2-1) and (2-2) or to a phosphonic acid group or a salt of the phosphonic acid group of General Formulae (2-1) and (2-2).

$M^1$ and $M^2$ each represent a hydrogen ion or a cation (in the present specification, "cation" does not include a hydrogen ion).

In a case where $M^1$ and $M^2$ each represent a cation, examples thereof include an alkali metal ion (for example, a lithium ion, a sodium ion, or a potassium ion), an alkaline earth metal ion (preferably a calcium salt or a magnesium salt), and an ammonium ion.

Examples of the ammonium ion include $NH^{4+}$, a monoalkyl ammonium ion, a dialkyl ammonium ion, a trialkyl ammonium ion, and a tetraalkyl ammonium ion. The number of carbon atoms in the alkyl group which can constitute the ammonium ion is preferably 1 to 5, more preferably 1 to 3, and even more preferably 1 or 2. Furthermore, the alkyl group which can constitute the ammonium ion may have a substituent. Examples of those preferable as the substituent include a hydroxyl group, a halogen atom, and the like.

$M^1$ and $M^2$ preferably each represent a hydrogen ion or an ammonium ion, and more preferably each represent a hydrogen ion.

Specific examples of those preferable as monomers from which the constitutional unit represented by General Formula (2-1) or (2-2) is derived include 2-methacryloyloxyethyl acid phosphate (LIGHT ESTER P-1M manufactured by KYOEISHA CHEMICAL Co., LTD and PHOSMER M manufactured by Uni-Chemical Co., Ltd.), acid phosphoxypolyoxyethylene glycol monomethacrylate (PHOSMER PE manufactured by Uni-Chemical Co., Ltd.), 3-chloro-2-acid phosphoxypropyl methacrylate (PHOSMER CL manufactured by Uni-Chemical Co., Ltd.), acid phosphoxypolyoxypropylene glycol monomethacrylate (PHOSMER PP manufactured by Uni-Chemical Co., Ltd.), vinylphosphonic acid, and salts of these. Examples of those preferable as counterions constituting such salts include ions like alkali metal ions such as a sodium ion, a potassium ion, and a lithium ion, alkaline earth metal ions such as a calcium ion and a magnesium ion, and an ammonium ion. Furthermore, as the aforementioned salts, a dimethylaminoethyl methacrylate half salt of 2-methacryloyloxyethyl acid phosphate (PHOSMER MH) is preferably used.

The resin in which $M^1$ and $M^2$ each represent a cation may be prepared by copolymerizing a monomer in which $M^1$ and $M^2$ each represent a cation or prepared by copolymerizing a monomer in which $M^1$ and $M^2$ each represent a hydrogen ion and then neutralizing the copolymer with a base.

The constitutional unit represented by General Formula (2-1) or (2-2) can cause the resin to be localized in the surface side of the paper medium by interacting with the paper medium, and can cause the surface side of the paper medium to become more homogeneously hydrophobic. Particularly, in a case where the paper medium has a coating layer (coated layer) containing calcium carbonate, and a fine resin particle layer is formed on the coating layer, due to the interaction between the constitutional unit represented by General Formula (2-1) or (2-2) and calcium carbonate, the fine resin particles can be more efficiently localized in the surface side of the paper medium, and the permeation of moisture to the interior of the paper medium can be more effectively blocked. Furthermore, the constitutional unit represented by General Formula (2-1) or (2-2) substantially does not affect the quality (degree of gloss) of the image formed on the paper medium.

It is preferable that the resin is contained on the coating layer and/or in the coating layer.

The aforementioned coating layer containing calcium carbonate may further contain kaolin, an organic polymer (preferably styrene-butadiene rubber), and the like. The content of calcium carbonate in the coating layer containing calcium carbonate is generally 50% to 90% by mass, preferably 55% to 80% by mass, and even more preferably 60% to 75% by mass.

The thickness of the coating layer is preferably 5 to 40 μm, and more preferably 10 to 30 μm.

In the aforementioned resin, the total content of the constitutional unit represented by General Formula (2-1) and the constitutional unit represented by General Formula (2-2) (in a case where the resin does not contain any one of the constitutional unit represented by General Formula (2-1) and the constitutional unit represented by General Formula (2-2), the content of the constitutional unit contained in the resin is the total content) is 4% to 70% by mass, preferably 4% to 50% by mass, even more preferably 4% to 30% by mass, still more preferably 5% to 25% by mass, and yet more preferably 6 to 20% by mass.

In the resin, a ratio of a content Y (% by mass) of the constitutional unit represented by General Formula (1) to a total content X (% by mass) of the constitutional unit represented by General Formula (2-1) and the constitutional unit represented by General Formula (2-2) preferably satisfies $4 \leq Y/X \leq 15$, more preferably satisfies $5 \leq Y/X \leq 13$, and even more preferably satisfies $7 \leq Y/X \leq 11$. In a case where the ratio of Y to X is within the above range, cockling can be further inhibited, and the degree of gloss can be further improved. In addition, the dispersibility of the resin in water can be improved, and in a case where an aqueous dispersion of fine resin particles is applied onto the paper medium as will be described later such that the resin is incorporated into the paper medium, the resin can be more homogeneously and efficiently incorporated into the paper medium.

It is preferable that the aforementioned resin further has a constitutional unit represented by General Formula (3). In a case where the resin has the constitutional unit represented by General Formula (3), the dispersibility of the obtained resin in water can be further improved, and at the time of applying an aqueous dispersion of fine resin particles onto the paper medium as will be described later such that the resin is incorporated into the paper medium, the resin can be more homogeneously and efficiently incorporated into the paper medium.

General Formula (3)

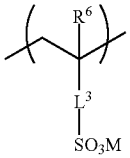

In General Formula (3), $R^6$ represents a hydrogen atom or methyl, and is preferably a hydrogen atom.

$L^3$ represents a single bond or a divalent linking group, and is preferably a divalent linking group. As the divalent linking group, a divalent linking group selected from Formulae (3a) to (3f) is preferable. Among these, a divalent linking group represented by Formula (3a) is particularly preferable.

Formula (3a)

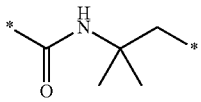

Formula (3b)

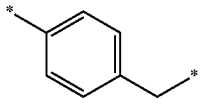

Formula (3c)

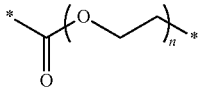

Formula (3d)

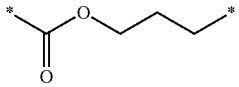

Formula (3e)

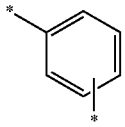

Formula (3f)

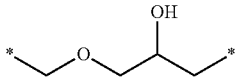

In Formulae (3a) to (3f), * represents a linking site. n represents an integer of 1 to 5, and is preferably 1 to 3. In Formulae (3a) to (3f), between two linking sites *, the linking site * shown on the left side is preferably linked to a main chain side in the constitutional unit represented by General Formula (3).

M represents a hydrogen ion or a cation, and is preferably a hydrogen ion. Examples of those preferable as the cation which can be adopted as M are the same as the cations which can be adopted as $M^1$ described above.

Specific examples of monomers from which the constitutional unit represented by General Formula (3) is derived include 2-acrylamido-2-methylpropanesulfonic acid, vinylsulfonic acid, styrenesulfonic acid, α-methylstyrenesulfonic acid, 2-sulfoethyl (meth)acrylate, 3-sulfopropyl (meth)acrylate, (meth)acryloyloxyethyl sulfonate, vinyl benzyl sulfonate, 1-acryloxy-2-hydroxypropane sulfonate, acryloxypolyethylene glycol (a degree of polymerization of an ethylene glycol portion: 10) sulfonate, and salts of these. Examples of those preferable as counterions constituting such salts include ions like alkali metal ions such as a sodium ion, a potassium ion, and a lithium ion, alkaline earth metal ions such as a calcium ion and a magnesium ion, and an ammonium ion.

The constitutional unit represented by General Formula (3) is preferably a constitutional unit derived from 2-acrylamido-2-methylpropanesulfonic acid or a salt thereof (preferably a sodium salt, a potassium salt, or a lithium salt) or from 3-sulfopropyl (meth)acrylate among the above monomers.

The resin in which M represents a cation may be prepared by copolymerizing a monomer in which M represents a cation or by copolymerizing a monomer in which M represents a hydrogen ion and then neutralizing the copolymer with a base.

In the aforementioned resin, the content of the constitutional unit represented by General Formula (3) is preferably 1% to 40% by mass, more preferably 2% to 30% by mass, even more preferably 3% to 20% by mass, and still more preferably 4% to 15% by mass.

In the resin, a ratio of the content Y (% by mass) of the constitutional unit represented by General Formula (1) to a content Z (% by mass) of the constitutional unit represented by General Formula (3) preferably satisfies $5 \leq Z/Y \leq 12$, and more preferably satisfies $6 \leq Z/Y \leq 10$. In a case where the ratio of Y to Z is within the above range, the particle size distribution obtained after the aqueous dispersion of the resin is prepared can become more uniform, and at the time of applying an aqueous dispersion of fine resin particles onto the paper medium as will be described later such that the resin is incorporated into the paper medium, the resin can be more efficiently incorporated into the paper medium with high uniformity.

The aforementioned resin may contain a constitutional unit (optional constitutional unit) which is not represented by any of General Formula (1), General Formula (2-1), General Formula (2-2), and General Formula (3). Examples of such a constitutional unit include constitutional units derived from methyl (meth)acrylate, ethyl (meth)acrylate, n-propyl (meth)acrylate, iso-propyl (meth)acrylate, 2-hydroxyethyl methacrylate, (meth)acrylic acid, phenylbenzoic acid, acrylamide, acrylonitrile, styrene, and the like.

In the resin, the content of the optional constitutional unit is preferably 0% to 60% by mass, more preferably 0% to 50% by mass, and even more preferably 0% to 40% by mass. The content of the optional constitutional unit may be 5% to 40% by mass or 10% to 40% by mass.

The aforementioned resin is water-insoluble. In the present specification, "water-insoluble" means that the solubility of the resin in 100 g of water (25° C.) is equal to or lower than 5.0 g. The solubility of the resin in 100 g of water (25° C.) is preferably 0.01 to 3.0 g, and more preferably 0.01 to 2.0 g.

The weight-average molecular weight of the resin is preferably 5,000 to 500,000, and more preferably 10,000 to 40,000. The weight-average molecular weight of the resin constituting the fine resin particles can be measured by the method described in examples which will be described later.

In the image recording paper medium of the present invention, from the viewpoint of a degree of gloss, the content of the resin is preferably equal to or smaller than 5 $g/m^2$. From the viewpoint of satisfying both the water barrier function and the degree of gloss, the content of the resin is more preferably 0.006 to 5 $g/m^2$, even more preferably 0.01 to 4 $g/m^2$, still more preferably 0.1 to 3 $g/m^2$, yet more preferably 0.3 to 3 $g/m^2$, and much more preferably 0.6 to 2 $g/m^2$. The content of the resin can also be calculated from the amount of the resin applied. Furthermore, in a case where the resin exists on the surface of the image recording paper medium, a coverage ratio of the surface of the image recording paper medium covered with the resin can be measured by X-ray photoelectron spectroscopy (XPS analysis). For example, based on a ratio of the amount of each element in the surface determined after the formation of the fine resin particle layer to the amount of the element such as calcium, aluminum, or silica measured in the surface of the paper medium as a raw material, the coverage ratio of the fine resin particles can be measured. The coverage ratio determined by XPS is preferably 70% to 100%.

In the image recording paper medium of the present invention, the resin preferably uniformly (homogeneously) exists in the surface of the image recording paper medium (image recording surface) or in a surface parallel to the surface of the image recording paper medium.

In the present invention, the thickness of the image recording paper medium is 20 to 400 μm.

[Manufacturing of Image Recording Paper Medium]

The image recording paper medium of the present invention can be obtained by coating a paper medium, which is generally used for forming an image, with a dispersion which is obtained by dispersing fine particles of the aforementioned resin (hereinafter, simply referred to as "fine resin particles") in an aqueous medium (hereinafter, the dispersion will be simply referred to as "aqueous dispersion of fine resin particles" as well). In a case where the aqueous dispersion of fine resin particles is used, it is possible to homogeneously and efficiently incorporate the resin into the paper medium (preferably into the surface layer of the paper medium) while inhibiting the aqueous medium from permeating the interior of the paper medium.

The method for preparing the fine resin particles is not particularly limited, and methods such as batch polymerization, semi-batch polymerization, and seeded polymerization can be used. Furthermore, the fine resin particles can be prepared by a phase-transfer emulsification method. The phase-transfer emulsification method is a method in which a resin which should be dissolved is dispersed in a hydrophobic organic solvent that can dissolve the resin, a compound (for example, a base) for neutralizing a salt generating group (for example, an acidic group) contained in the resin is added to the obtained solution (organic continuous phase (O-phase)) such that the salt generating group is neutralized, and then an aqueous medium (W-phase) is added thereto such that the form of the resin undergoes conversion (so-called transfer) from an oil-in-water droplet (O/W) to a water-in-oil droplet (W/O), thereby dispersing the resin in the aqueous medium in the form of particles.

In addition, it is also preferable to adopt a general emulsion polymerization method. Examples of emulsifiers used in the emulsion polymerization method include nonionic surfactants such as an alkyl ester type, an alkyl phenyl ether type, or an alkyl ether type polyethylene glycol and anionic surfactants such as rosinate, a fatty acid salt, a sulfuric acid ester salt of a higher alcohol, alkylbenzene sulfonate, alkyldiphenylether sulfonate, aliphatic sulfonate, aliphatic carboxylate, a sulfonic acid salt of a nonionic surfactant, and a formalin condensate of naphthalene sulfonate.

Among these emulsifiers, anionic surfactants are preferable, and rosinate or a formalin condensate of naphthalene sulfonate is more preferable.

One kind of emulsifier or two or more kinds of emulsifiers can be used.

At the time of preparing the aforementioned fine resin particles, it is preferable to use a polymerization initiator.

As the polymerization initiator, a radical polymerization initiator is preferable.

Examples of the polymerization initiator include persulfates such as potassium peroxodisulfate (potassium persulfate), sodium peroxodisulfate (sodium persulfate), and ammonium peroxodisulfate (ammonium persulfate), azo initiators such as 2,2-azobis-(2-aminodipropane)dihydrochloride, 4,4'-azobis(4-cyanovaleric acid), 2,2'-azobis[N-(2-carboxyethyl)-2-methylpropionamidine]hydrochloride, 2,2'-azobis{2-methyl-N-[2-(1-hydroxybutyl)]propionamide}, 2,2'-azobis[2-methyl-N-(2-hydroxyethyl)propionamide], 2,2'-azobis(2-aminopropane)hydrochloride, 2,2'-azobis[2-(3,4,5,6-tetrahydropyrimidin-2-yl)propane]hydrochloride, 2,2'-azobis{2-[1-(2-hydroxyethyl)-2-imidazolin-2-yl]propane}hydrochloride, 2,2'-azobis(2-methylbutanamidoxime)dihydrochloride, and 4'-azobis(4-cyanovaleric acid), and peroxides such as cumene hydroperoxide, benzoyl peroxide, t-butyl hydroperoxide, acetyl peroxide, diisopropylbenzene hydroperoxide, and 1,1,3,3-tetramethylbutyl hydroperoxide.

Among these polymerization initiators, 4,4'-azobis(4-cyanovaleric acid) or 2,2'-azobis[N-(2-carboxyethyl)-2-methylpropionamidine]hydrochloride is preferable.

In preparing the aforementioned fine resin particles, if necessary, a reductone or a chain transfer agent may be used. Examples of the reductone include sulfite, bisulfite, pyrosulfite, dithionite, dithionate, thiosulfate, formaldehyde sulfonate, benzaldehyde sulfonate, L-ascorbic acid, erythrobic acid; carboxylic acids such as tartaric acid and citric acid and salts of these; reducing sugar such as dextrose and saccharose, and amine compounds such as dimethylaniline and triethanolamine. Among these, carboxylic acids and salts thereof are preferable. As more preferable reductones, L-ascorbic acid and erythrobic acid can be exemplified.

<Paper Medium>

In manufacturing the image recording paper medium of the present invention, as the paper medium used as a raw material, commercial products that are generally available can be used. Examples of the paper medium include fine paper (A) such as "OK PRINCE FINE" manufactured by Oji Paper Co., Ltd., "SHIRAOI" manufactured by NIPPON PAPER INDUSTRIES CO., LTD., and "NEW NPI FINE" manufactured by NIPPON PAPER INDUSTRIES CO., LTD., fine coated paper such as "SILVERDIA" manufactured by NIPPON PAPER INDUSTRIES CO., LTD., lightly coated paper such as "OK EVERLIGHT COAT" manufactured by Oji Paper Co., Ltd. and "AURORA S" manufactured by NIPPON PAPER INDUSTRIES CO., LTD., lightweight coated paper (A3) such as "OK COAT L" manufactured by Oji Paper Co., Ltd. and "AURORA L" manufactured by NIPPON PAPER INDUSTRIES CO., LTD., coated paper (A2, B2) such as "OK TOPCOAT+" manufactured by Oji Paper Co., Ltd. and "AURORA COAT" manufactured by NIPPON PAPER INDUSTRIES CO., LTD., art paper (A1) such as "OK KINFUJI+" manufactured by Oji Paper Co., Ltd. and "TOKUBISHI ART" manufactured by MITSUIBISHI PAPER MILLS LIMITED, and the like. Furthermore, various exclusive paper for a photograph for ink jet recording can also be used.

Among the above paper media, coated paper is preferable as described above. The coated paper is obtained by providing a coating layer by coating the surface of base paper (pulp layer) such as fine paper, alkaline paper, or the like which mainly consists of cellulose and generally has not undergone a surface treatment with a coating material. It is particularly preferable to use coated paper obtained by providing a coating layer containing calcium carbonate on a pulp layer. Furthermore, it is preferable to use coated paper having a coating layer containing kaolin and calcium carbonate on a pulp layer. More specifically, art paper, coated paper, lightweight coated paper, or lightly coated paper is more preferable.

Among the aforementioned paper media, from the viewpoint of obtaining a high-quality image in which the migration of coloring materials is very effectively inhibited and which has color density and hue better than those of the related art, paper media having a water absorption coefficient Ka of 0.05 to 0.5 $mL/m^2 \cdot ms^{1/2}$ are preferable, paper media having a water absorption coefficient Ka of 0.1 to 0.4 $mL/m^2 \cdot ms^{1/2}$ are more preferable, and paper media having a water absorption coefficient Ka of 0.2 to 0.3 $mL/m^2 \cdot ms^{1/2}$ are even more preferable.

The water absorption coefficient Ka has the same definition as the absorption coefficient described in JAPAN TAPPI paper pulp test method No. 51:2000 (published from Japan Tappi.). Specifically, by using an automatic scanning liquid absorptometer KM500Win (manufactured by KUMAGAI RIKI KOGYO Co., Ltd.), the amounts of water transferred are measured at a contact time of 100 ms and a contact time of 900 ms, and from a difference therebetween, the water absorption coefficient Ka is calculated.

<Coating of Paper Medium with Aqueous Dispersion of Fine Resin Particles>

The method for coating the aforementioned paper medium with the aqueous dispersion of fine resin particles is not particularly limited, and commonly used coating methods can be used without particular limitation. For example, it is possible to adopt a wide variety of methods such as an ink jet method, a spray coating method, a roller coating method, and a dipping method.

Specific examples of the coating method of the aqueous dispersion of fine resin particles include a size press method represented by a horizontal size press method, a roll coater method, a calender size press method, or the like; a size press method represented by an air knife coater method or the like; a knife coater method represented by an air knife coater method or the like; a roll coater method represented by a transfer roll coater method such as gate roll coater method, a direct roll coater method, a reverse roll coater method, a squeeze roll coater method, or the like; a building blade coater method, a short dwell coater method; a blade coater method represented by a two stream coater method or the like; a bar coater method represented by a rod bar coater method or the like; a cast coater method; a gravure coater method; a curtain coater method; a die coater method, a brush coater method; a transfer method; and the like.

Furthermore, a method may be used in which the coating amount is controlled by using a coating device that includes a liquid amount restriction member just like the coating device described in JP1998-230201A (JP-H10-230201A).

The aqueous dispersion of fine resin particles may be used for full coating by which the entirety of the paper medium is coated or used for partial coating by which a region coated with an ink in an ink application step is partially coated.

From the viewpoint of a degree of gloss, it is preferable that the paper medium is coated with the aqueous dispersion of fine resin particles such that the coating amount of the fine resin particles becomes equal to or smaller than 5 $g/m^2$. The paper medium is coated with the aqueous dispersion of fine resin particles such that the amount of the fine resin particles more preferably becomes 0.006 to 5 $g/m^2$, even more preferably becomes 0.01 to 4 $g/m^2$, still more preferably becomes 0.1 to 3 $g/m^2$, yet more preferably becomes 0.3 to 3 $g/m^2$, and much more preferably becomes 0.6 to 2 $g/m^2$.

In order to make the coating amount of the fine resin particles applied to the paper medium fall into the aforementioned preferable range, the concentration of the fine resin particles in the aqueous dispersion of fine resin particles is preferably 1% to 50% by mass, more preferably 5% to 40% by mass, and even more preferably 10% to 30% by mass.

Examples of the aqueous medium used as a medium of the aqueous dispersion of fine resin particles include water or a mixed solvent of water and a water-soluble organic solvent. The water-soluble organic solvent is not particularly limited, and examples thereof include water-soluble organic solvents which can be used in an aqueous ink which will be described later.

Furthermore, an aspect is also preferable in which the aqueous medium contains an organic acid. Examples of the organic acid are the same as the examples of the organic acid which can be used in an acidic treatment liquid which will be described later, and preferable aspects thereof are also the same. In addition, if necessary, the aqueous medium may contain an inorganic acid (phosphoric acid or the like) together with an organic acid. In a case where the aqueous dispersion of fine resin particles is prepared using the aqueous medium containing an organic acid, both the characteristics including the moisture barrier function and the ink aggregating ability can be imparted to the image recording paper medium obtained by coating performed using the aqueous dispersion of fine resin particles.

In a case where an organic acid is incorporated into the aqueous dispersion of fine resin particles for the purpose of imparting the ink aggregating ability thereto, it is preferable to formulate the organic acid with the aqueous dispersion of fine resin particles such that the pH of the aqueous dispersion becomes 0.1 to 6.0 (preferably 0.5 to 5.0) at 25° C.

The content of water in the aforementioned aqueous medium is preferably 30% to 90% by mass, and more preferably 50% to 80% by mass.

From the viewpoint of coating suitability, the viscosity of the aqueous dispersion of fine resin particles at 25° C. is preferably 0.1 to 100 mPa·s, and more preferably 0.3 to 50 mPa·s. The viscosity is measured based on JIS Z 8803.

In the aqueous dispersion of fine resin particles, a volume average particle size of the fine resin particles is preferably 0.001 to 1 μm, more preferably 0.01 to 0.5 μm, and even more preferably 0.02 to 0.3 μm. The volume average particle size of the fine resin particles in the aqueous dispersion of fine resin particles is measured by a dynamic light scattering method by using a nanotrac particle size distribution measurement apparatus UPA-EX150 (manufactured by NIKKISO CO., LTD).

The aqueous dispersion of fine resin particles may contain, in addition to the fine resin particles, a surfactant, an anti-foaming agent, a low-molecular weight organic acid, a pH adjuster, a viscosity adjuster, a preservative, a rust inhibitor, and the like.

In a case where the aqueous dispersion of fine resin particles does not contain an organic acid and does not have an ink aggregating ability, before or after the paper medium is coated with the aqueous dispersion of fine resin particles, the surface of the paper medium may be treated with an acidic treatment liquid so as to form a layer inducing the aggregation of an ink. This aspect is also preferable as the image recording paper medium of the present invention.

<Acidic Treatment Liquid>

As the acidic treatment liquid, a solution containing an organic acid (hereinafter, referred to as "organic acid solution") is preferable. The organic acid solution is generally an aqueous solution. It is also preferable that the acidic treatment liquid contains an inorganic acid (phosphoric acid or the like) together with an organic acid.

—Organic Acid—

The organic acid is a compound which induces the aggregation (immobilization) of the components in the aqueous ink by coming into contact with the aqueous ink on the recording medium. That is, the organic acid functions as an immobilizing agent.

Examples of the organic acid include polyacrylic acid, acetic acid, glycolic acid, malonic acid, malic acid, maleic acid, ascorbic acid, succinic acid, glutaric acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, propane tricarboxylic acid, coumaric acid, thiophene carboxylic acid, nicotinic acid, oxalic acid, benzoic acid, and a phosphoric acid compound. From the viewpoint of accomplishing both the inhibition of volatilization and the solubility in a solvent, the organic acid is preferably an acid having a molecular weight of equal to or greater than 35 and equal to or smaller than 1,000, more preferably an acid having a molecular weight of equal to or greater than 50 and equal to or smaller than 500, and particularly preferably an acid having a molecular weight of equal to or greater than 50 and equal to or smaller than 200. Furthermore, from the viewpoint of accomplishing both the prevention of blurring of ink and photocuring properties, the organic acid is preferably an acid having a pKa (in $H_2O$, 25° C.) of equal to or greater than −10 and equal to or smaller than 7, more preferably an acid having a pKa of equal to or greater than 1 and equal to or smaller than 7, and particularly preferably an acid having a pKa of equal to or greater than 1 and equal to or smaller than 5.

As the pKa, it is possible to use values calculated by Advanced Chemistry Development (ACD/Labs) Software V11.02 (1994-2014 ACD/Labs) or values described in documents (such as J. Phys. Chem. A 2011, 115, 6641 to 6645).

As the organic acid used in the present invention, an acidic compound having high water solubility is preferable. From the viewpoint of immobilizing the entirety of the ink by reacting with the ink components, the organic acid is preferably an acidic compound having three or less hydrogen atoms, and particularly preferably an acidic compound having two or three hydrogen atoms.

The organic acid is preferably one kind of compound or two or more kinds of compounds selected from DL-malic acid, malonic acid, glutaric acid, maleic acid, a carboxylic acid compound, and a phosphoric acid compound.

As the carboxylic acid compound, propane tricarboxylic acid is preferable.

As the aforementioned phosphoric acid compound, an inorganic phosphoric acid compound selected from orthophosphoric acid (hereinafter, simply referred to as "phosphoric acid"), phosphorous acid, hypophosphorous acid, pyrophosphoric acid, metaphosphoric acid, polyphosphoric acid, and a salt of these is preferable.

The content of the organic acid in the organic acid solution is preferably equal to or smaller than 40% by mass, more preferably 15% to 40% by mass, even more preferably 15% to 35% by mass, and particularly preferably 20% to 30% by mass. In a case where the content of the organic acid in the organic acid solution is within the above preferable range, the components in the ink can be more efficiently immobilized.

From the viewpoint of facilitating the aggregation of the ink composition, the pH of the organic acid solution is preferably 0.1 to 6.0 and more preferably 0.5 to 5.0 at 25° C.

Furthermore, from the viewpoint of coating properties, the viscosity of the organic acid solution at 25° C. is preferably 0.1 to 100 mPa·s, and more preferably 0.5 to 80 mPa·s.

The coating amount of the organic acid solution applied onto the paper medium is not particularly limited as long as the amount is enough for causing the aggregation of the aqueous ink. From the viewpoint of facilitating the immobilization of the aqueous ink, it is preferable that the paper medium is coated with the organic acid solution such that the coating amount of the organic acid becomes 0.1 g/m$^2$ to 2.0 g/m$^2$, and coated with the treatment agent such that the coating amount of the organic acid becomes 0.2 g/m$^2$ to 1.5 g/m$^2$.

As described above, as in the case where the aqueous dispersion of fine resin particles contains an organic acid for the purpose of aggregating the ink, the paper medium is preferably coated with the aqueous dispersion of fine resin particles such that the coating amount of the organic acid becomes 0.1 g/m$^2$ to 2.0 g/m$^2$, and more preferably coated with the aqueous dispersion of fine resin particles such that the coating amount of the organic acid becomes 0.2 g/m$^2$ to 1.5 g/m$^2$.

The organic acid solution may further contain a water-soluble organic solvent and/or a surfactant, in addition to the aforementioned organic acid and water. Furthermore, the organic acid solution may contain commonly used additives such as an ultraviolet absorber, a fading inhibitor, an anti-fungal agent, a pH adjuster, a rust inhibitor, an antioxidant, an emulsion stabilizer, a preservative, an anti-foaming agent, a viscosity adjuster, a dispersion stabilizer, and a chelating agent.

The paper medium coated with the aqueous dispersion of fine resin particles is generally subjected to a drying treatment. The drying treatment is not particularly limited, and for example, it is possible to adopt a heating treatment (heating treatment performed at 40° C. to 250° C., preferably at 50° C. to 200° C., and even more preferably at 60° C. to 150° C.), a blasting treatment (exposure to dry air), and the like.

In a case where the paper medium is coated with the aqueous dispersion of fine resin particles and then dried, some or all of the fine resin particles are generally fused with each other and constitute the image recording paper medium.

In a case where the image recording paper medium of the present invention adopts an aspect in which a fine resin particle layer is provided on the coating layer containing calcium carbonate, the fine resin particle layer can be manufactured by coating the coating layer, which contains calcium carbonate, of the paper medium used as a raw material with the aforementioned aqueous dispersion of fine resin particles.

In this case, the calcium carbonate and the fine resin particles (particularly, the calcium carbonate and the constitutional unit represented by General Formula (2-1) or (2-2)) appropriately interact with each other as intended. Accordingly, the fine resin particles can be more reliably localized on the surface side, and the barrier function thereof can be further improved.

In a case where an image is formed on the image recording paper medium of the present invention by using an aqueous ink, moisture does not easily permeate the image recording paper medium, and the deformation (cockling) of the paper medium resulting from the application of the aqueous ink is effectively inhibited. Furthermore, a degree of gloss of the image formed on the image recording paper medium of the present invention is substantially the same as a degree of gloss of an image formed on the paper medium used as a raw material. That is, in a case where the image recording paper medium of the present invention is used, it is possible to excellently inhibit the deformation of the paper medium while suppressing the change in the image characteristics (degree of gloss) and to form a high-quality image.

[Image Recording Method]

The image recording method of the present invention includes a step (referred to as "step (a)" as well) of obtaining an image recording paper medium by the aforementioned method and a step (referred to as "step (b)" as well) of forming an image by jetting an aqueous ink by using an ink jet method to a surface of the obtained image recording paper medium coated with the aforementioned aqueous dispersion of fine resin particles. The step (a) is as described above in [Manufacturing of image recording paper medium]. The step (b) will be described below.

<Step (b)>

In the step (b), by jetting an aqueous ink by using an ink jet method to the surface (coated and dried surface) of the image recording paper medium obtained in the step (a) that is coated with the aforementioned aqueous dispersion of fine resin particles, an image is formed.

—Aqueous Ink—

The aqueous ink used in the present invention contains at least a colorant and water, and generally further contains a water-soluble organic solvent. The aqueous ink used in the present invention is in the form of a composition in which the respective components are homogeneously mixed together.

The aqueous ink (hereinafter, simply referred to as an "ink" in some cases) used in the present invention can be used not only for forming a monochromic image, but also for forming a polychromic image (such as a full color image). An image can be formed by selecting the aqueous ink with one intended color or selecting the aqueous inks with two or more intended colors. For forming a full color image, for example, as the inks, it is possible to use inks with magenta tone, cyan tone, and yellow tone can be used. Furthermore, an ink with black tone may also be used.

The aqueous ink used in the present invention may be an ink with yellow (Y) tone, magenta (M) tone, cyan (C) tone, black (K) tone, red (R) tone, green (G) tone, blue (B) tone, or white (W) tone, or may be a so-called special color ink in the field of printing.

The aqueous ink with each color tone described above can be prepared by changing the color of the colorant as intended.

(Colorant)

In the aqueous ink used in the present invention, a commonly used dye, pigment, or the like can be used as a colorant without particular limitation. From the viewpoint of the coloring properties of the formed image, a colorant is preferable which substantially does not dissolve in water or poorly dissolves in water. Specific examples thereof include various pigments, dispersed dyes, oil-soluble dyes, coloring agents forming a J-aggregate, and the like. Considering light fastness, the colorant is more preferably a pigment.

The type of the pigment that can be contained in the aqueous ink used in the present invention is not particularly limited, and general organic or inorganic pigments can be used.

Examples of the organic pigments include an azo pigment, a polycyclic pigment, a chelate dye, a nitro pigment, a nitroso pigment, aniline black, and the like. Among these, an azo pigment or a polycyclic pigment is more preferable. Examples of the azo pigment include azo lake, an insoluble azo pigment, a condensed azo pigment, and a chelated azo pigment. Examples of the polycyclic pigment include a phthalocyanine pigment, a perylene pigment, a perinone pigment, an anthraquinone pigment, a quinacridone pigment, a dioxazine pigment, an indigo pigment, a thioindigo pigment, an isoindolinone pigment, and a quinophthalone pigment. Examples of the chelate dye include a basic dye-type chelate and an acid dye-type chelate.

Examples of the inorganic pigments include titanium oxide, iron oxide, calcium carbonate, barium sulfate, aluminum hydroxide, barium yellow, cadmium red, chromium yellow, carbon black, and the like. Among these, carbon black is preferable. Examples of the carbon black include those manufactured by a common method such as a contact method, a furnace method, or a thermal method.

Specific examples of the pigments that can be used in the present invention include the pigments described in paragraphs "0142" to "0145" in JP2007-100071A and the like.

In a case where a dye is used as a coloring component in the present invention, a dye supported on a water-insoluble support can be used as a colorant. Commonly used dyes can be used as the dye without particular limitation. For example, in the present invention, the dyes described in JP2001-115066A, JP2001-335714A, JP2002-249677A, and the like can also be suitably used. Furthermore, the support is not particularly limited as long as it is insoluble or poorly soluble in water. As the support, an inorganic material, an organic material, or a composite material of these can be used. Specifically, in the present invention, the supports described in JP2001-181549A, JP2007-169418A, and the like can also be suitably used.

The support (colorant) supporting a dye can be used as is. Alternatively, if necessary, it can be used in combination with a dispersant. As the dispersant, a dispersant which will be described later can be suitably used.

One kind of the colorant may be used singly, or plural kinds thereof may be selected and used in combination.

From the viewpoint of the color density, the graininess, the stability of the ink, and the jetting reliability, the content of the colorant in the aqueous ink used in the present invention is preferably 1% to 35% by mass and more preferably 1% to 25% by mass, with respect to the total mass of the aqueous ink.

(Dispersant)

In a case where the aqueous ink used in the present invention is an aqueous ink, and the colorant is a pigment, it is preferable that the pigment constitutes coloring particles dispersed in an aqueous solvent by a dispersant (hereinafter, simply referred to as "coloring particles").

The dispersant may be a polymer dispersant or a low-molecular weight surfactant-type dispersant. Furthermore, the polymer dispersant may be either a water-soluble polymer dispersant or a water-insoluble polymer dispersant.

As the low-molecular weight surfactant-type dispersant, for example, commonly used low-molecular weight surfactant-type dispersants described in paragraphs "0047" to "0052" in JP2011-178029A can be used.

Examples of the water-soluble dispersant among the polymer dispersants include a hydrophilic polymer compound. Examples of a natural hydrophilic polymer compound include a vegetable polymer such as gum Arabic, gum tragacanth, guar gum, karaya gum, locust bean gum, arabinogalactone, pectin, or quince seed starch, a seaweed-based polymer such as alginic acid, carrageenan, or agar, an animal polymer such as gelatin, casein, albumin, or collagen, a microorganism-based polymer such as xanthan gum or dextrin, and the like.

Examples of a modified hydrophilic polymer compound using a natural substance as a raw material include a cellulose-based polymer such as methylcellulose, ethylcellulose, hydroxyethyl cellulose, hydroxypropyl cellulose, or carboxymethyl cellulose, a starch-based polymer such as sodium starch glycolate or sodium starch phosphoric acid ester, a seaweed-based polymer such as sodium alginate or propylene glycol alginic acid ester, and the like.

Examples of a synthetic hydrophilic polymer compound include a vinyl-based polymer such as polyvinyl alcohol, polyvinylpyrrolidone, or polyvinyl methyl ether, an acrylic resin such as non-crosslinked polyacrylamide, polyacrylic acid or an alkali metal salt thereof, or a water-soluble styrene acrylic resin, a water-soluble styrene-maleic acid resin, a water-soluble vinylnaphthalene acrylic resin, a water-soluble vinylnaphthalene-maleic acid resin, a polymer compound having a salt of a cationic functional group such as polyvinylpyrrolidone, polyvinyl alcohol, an alkali metal salt of β-naphthalene sulfonate formalin condensate, quaternary ammonium, or an amino group on a side chain thereof, a natural polymer compound such as shellac, and the like.

Among the above polymers, a hydrophilic polymer compound into which a carboxyl group is introduced, such as a homopolymer of acrylic acid or methacrylic acid or a copolymer of acrylic acid or methacrylic acid with other monomers, is preferable.

The water-insoluble polymer dispersant is not particularly limited as long as it is a water-insoluble polymer and can disperse a pigment, and a commonly used water-insoluble polymer dispersant can be used. For example, the water-insoluble polymer dispersant can be constituted with both a hydrophobic structural unit and a hydrophilic structural unit.

Examples of the monomer component constituting the hydrophobic structural unit include a styrene-based monomer component, an alkyl (meth)acrylate component, an aromatic group-containing (meth)acrylate component, and the like.

The monomer component constituting the hydrophilic structural unit is not particularly limited as long as it is a monomer component containing a hydrophilic group. Examples of the hydrophilic group include a nonionic group, a carboxyl group, a sulfonic acid group, a phosphoric acid group, and the like. Examples of the nonionic group include a hydroxyl group, an amide group (having an unsubstituted nitrogen atom), a group derived from an alkylene oxide polymer (such as polyethylene oxide or polypropylene oxide), a group derived from sugar alcohol, and the like.

From the viewpoint of the dispersion stability, the hydrophilic structural unit preferably contains at least a carboxyl group. It is also preferable that the hydrophilic structural unit contains both the nonionic group and the carboxyl group.

Specific examples of the water-insoluble polymer dispersant include a styrene-(meth)acrylic acid copolymer, a styrene-(meth)acrylic acid-(meth)acrylic acid ester copolymer, a (meth)acrylic acid ester-(meth)acrylic acid copolymer, a polyethylene glycol (meth)acrylate-(meth)acrylic acid copolymer, a styrene-maleic acid copolymer, and the like.

From the viewpoint of the dispersion stability of the pigment, the water-insoluble polymer dispersant is preferably a vinyl polymer containing a carboxy group, and more preferably a vinyl polymer having at least a structural unit derived from an aromatic group-containing monomer as the hydrophilic structural unit and a structural unit containing a carboxyl group as the hydrophilic structural unit.

From the viewpoint of the dispersion stability of the pigment, the weight-average molecular weight of the water-insoluble polymer dispersant is preferably 3,000 to 200,000, more preferably 5,000 to 100,000, even more preferably 5,000 to 80,000, and particularly preferably 10,000 to 60,000.

The weight-average molecular weight is measured by gel permeation chromatography (GPC). GPC is performed by using HLC-8220 GPC (manufactured by TOSOH CORPORATION) and using TSKgel Super HZM-H, TSKgel Super HZ4000, and TSKgel Super HZ2000 (manufactured by TOSOH CORPORATION, 4.6 mmID×15 cm) as columns. The conditions of GPC are specifically described in paragraph "0076" of JP2010-155359A.

From the viewpoint of the dispersibility of the pigment, the coloring properties of the ink, and the dispersion stability, the content of the dispersant in the coloring particles is preferably 10 to 90 parts by mass, more preferably 20 to 70 parts by mass, and particularly preferably 30 to 50 parts by mass, with respect to 100 parts by mass of the pigment.

It is preferable that the content of the dispersant in the coloring particles is within the above range, because then the pigment is coated with an appropriate amount of the dispersant, and coloring particles which have a small particle size and excellent temporal stability tend to be easily obtained.

For example, the coloring particles can be obtained in the form of a coloring particle dispersion by dispersing a mixture, which contains a pigment, a dispersant, and a solvent (preferably an organic solvent) used if necessary, and the like, by using a disperser.

For example, the coloring particle dispersion can be manufactured by performing a step (mixing•hydrating step) of adding a basic substance-containing aqueous solution to a mixture of the aforementioned pigment, the aforementioned polymer dispersant, and an organic solvent which dissolves or disperses the dispersant, and then performing a step (solvent removing step) of removing the organic solvent. In this way, the colorant is finely dispersed, and a dispersion of coloring particles having excellent preservation stability can be prepared.

The organic solvent needs to be able to dissolve or disperse the dispersant. In addition to this, it is preferable that the organic solvent exhibits affinity with water to some extent. Specifically, at 20° C., the degree of solubility of the organic solvent in water is preferably 10% to 50% by mass.

Preferred examples of the organic solvent include water-soluble organic solvents. Among these, isopropanol, acetone, and methyl ethyl ketone are preferable, and methyl ethyl ketone is particularly preferable. One kind of the organic solvent may be used singly, or plural kinds thereof may be used in combination.

The aforementioned basic substance is used for neutralizing an anionic group (preferably a carboxyl group) that the polymer has in some cases. A degree of neutralization of the anionic group is not particularly limited. Generally, the finally obtained coloring particle dispersion preferably has properties in which the pH thereof is 4.5 to 10, for example. The pH can be determined by an intended degree of neutralization of the aforementioned polymer.

In the process of manufacturing the coloring particle dispersion, the method for removing the organic solvent is not particularly limited, and a commonly used method such as distillation under reduced pressure can be used.

In the aqueous ink used in the present invention, one kind of the coloring particles may be used singly, or two or more kinds thereof may be used in combination.

In the present invention, the volume average particle size of the colorant (or the coloring particles) is preferably 10 to 200 nm, more preferably 10 to 150 nm, and even more preferably 10 to 100 nm. If the volume average particle size is equal to or smaller than 200 nm, color reproducibility becomes excellent, and jetting properties become excellent in the case of an ink jet method. If the volume average particle size is equal to or greater than 10 nm, light fastness becomes excellent.

The particle size distribution of the colorant (or the coloring particles) is not particularly limited, and may be wide particle size distribution or monodisperse particle size distribution. Furthermore, two or more kinds of colorants having monodisperse particle size distribution may be used by being mixed together.

The volume average particle size of the colorant (or the coloring particles) can be measured by using a Microtrac particle size measurement apparatus (trade name: Version 10.1.2-211BH, manufactured by NIKKISO CO., LTD.) by means of a dynamic light scattering method.

(Solvent)

The aqueous ink used in the present invention contains water as a solvent and generally further contains a water-soluble organic solvent. The content of water in the solvent contained in the aqueous ink is preferably equal to or greater than 10% by mass, more preferably 20% to 100% by mass, even more preferably 30% to 90% by mass, and still more preferably 40% to 80% by mass.

The water-soluble organic solvent which can be contained in the aqueous ink preferably has a degree of solubility in water of equal to or greater than 0.1% by mass at 20° C. Examples of the water-soluble organic solvent include an alcohol, ketone, an ether compound, an amide compound, a nitrile compound, and a sulfone compound.

The alcohol is not particularly limited, and examples thereof include ethanol, isopropanol, n-butanol, t-butanol, isobutanol, diacetone alcohol, diethylene glycol, ethylene glycol, dipropylene glycol, propylene glycol, glycerin, diethylene glycol methyl ether, and tripropylene glycol monomethyl ether.

The ketone is not particularly limited, and examples thereof include acetone, methyl ethyl ketone, diethyl ketone, and methyl isobutyl ketone.

The ether compound is not particularly limited, and examples thereof include dibutyl ether, tetrahydrofuran, dioxane, and tripropylene glycol monomethyl ether.

The amide compound is not particularly limited, and examples thereof include dimethylformamide and diethylformamide.

The nitrile compound is not particularly limited, and examples thereof include acetonitrile.

The sulfone compound is not particularly limited, and examples thereof include dimethyl sulfoxide, dimethyl sulfone, and sulfolane.

(Resin Particles)

If necessary, the aqueous ink used in the present invention can contain resin particles.

It is preferable that the resin particles have a function of fixing the ink by thickening the ink by being unstably dispersed and aggregated in a case where the resin particles come into contact with the aforementioned aggregation-inducing layer. It is preferable that such resin particles are dispersed in at least one of the water and organic solvent.

As the resin particles, it is possible to use an acrylic resin, a vinyl acetate-based resin, a styrene-butadiene-based resin, a vinyl chloride-based resin, an acryl-styrene-based resin, a butadiene-based resin, a styrene-based resin, a crosslinked acrylic resin, a crosslinked styrene-based resin, a benzoguanamine resin, a phenolic resin, a silicone resin, an epoxy resin, a urethane-based resin, a paraffin-based resin, a fluorine-based resin, or latex of these. Among these, an acrylic resin, an acryl-styrene-based resin, a styrene-based resin, a crosslinked acrylic resin, and a crosslinked styrene-based resin are preferable, for example.

It is also possible to use the resin particles in the form of latex.

The weight-average molecular weight of the polymer constituting the resin particles is preferably equal to or greater than 10,000 and equal to or smaller than 200,000, and more preferably equal to or greater than 20,000 and equal to or smaller than 200,000.

The volume average particle size of the resin particles is preferably within a range of 1 nm to 1 μm, more preferably within a range of 1 nm to 200 nm, even more preferably within a range of 2 nm to 100 nm, and particularly preferably within a range of 5 nm to 50 nm. The volume average particle size of the resin particles can be measured by the same method as used for measuring the volume average particle size of the aforementioned colorant.

A glass transition temperature Tg of the resin particles is preferably equal to or higher than 30° C., more preferably equal to or higher than 40° C., and even more preferably equal to or higher than 50° C.

Tg can be measured by using a differential scanning calorimeter (DSC) EXSTAR 6220 manufactured by SII NanoTechnology, Inc at a temperature increase rate of 10° C./min. At this time, the average of a temperature, at which a base line starts to change as the fine resin particles undergo transition to glass, and a temperature that returns to the base line is determined as Tg.

As the resin particles, it is preferable to use self-dispersing resin particles.

The self-dispersing resin refers to a water-insoluble resin which can be in a dispersed state in an aqueous medium by a functional group (particularly, an acidic group or a salt thereof) contained in the polymer in a case where the polymer is put into a dispersed state by a phase-transfer emulsification method in the absence of a surfactant.

Herein, the dispersed state includes both of an emulsified state (emulsion) in which the water-insoluble resin is dispersed in a liquid state in an aqueous medium and a dispersed state (suspension) in which the water-insoluble resin is dispersed in a solid state in an aqueous medium.

As the self-dispersing resin particles, it is possible to use the self-dispersing resin particles described in paragraphs "0090" to "0121" of JP2010-64480A and in paragraphs "0130" to "0167" of JP2011-068085A.

The molecular weight of the water-insoluble polymer constituting the self-dispersing resin particles is preferably 3,000 to 200,000, more preferably 5,000 to 150,000, and even more preferably 10,000 to 100,000, in terms of a weight-average molecular weight. By setting the weight-average molecular weight to be equal to or greater than 3,000, the amount of water-soluble components can be effectively reduced. Furthermore, by setting the weight-average molecular weight to be equal to or smaller than 200,000, the self-dispersion stability can be improved.

From the viewpoint of controlling the hydrophilicity and hydrophobicity of the polymer, the water-insoluble polymer constituting the resin particles preferably contain a constitutional unit derived from an aromatic group-containing (meth)acrylate monomer (preferably a constitutional unit derived from phenoxyethyl (meth)acrylate and/or a constitutional unit derived from benzyl (meth)acrylate) in an amount of 15% to 80% by mass in terms of a copolymerization ratio, with respect to the total mass of the self-dispersing polymer particles.

Furthermore, from the viewpoint of controlling the hydrophilicity and hydrophobicity of the polymer, the water-insoluble polymer preferably contains a structural unit derived from an aromatic group-containing (meth)acrylate monomer in an amount of 15% to 80% by mass in terms of a copolymerization ratio, a structural unit derived from a carboxyl group-containing monomer, and a constitutional unit derived from an alkyl group-containing monomer (preferably a structural unit derived from an alkyl ester of (meth)acrylic acid), more preferably contains a structural unit derived from phenoxyethyl (meth)acrylate and/or a structural unit derived from benzyl (meth)acrylate in an amount of 15% to 80% by mass in terms of a copolymerization ratio, a constitutional unit derived from a carboxyl group-containing monomer, and a constitutional unit derived from an alkyl group-containing monomer (preferably a structural unit derived from an alkyl ester of (meth) acrylic acid having 1 to 4 carbon atoms). In addition, the water-insoluble polymer preferably has an acid value of 25 to 100 and a weight-average molecular weight of 3,000 to 200,000, and more preferably has an acid value of 25 to 95 and a weight-average molecular weight of 5,000 to 150,000.

The content of the resin particles is preferably 0.1% to 20% by mass and more preferably 0.1% to 10% by mass, with respect to the total mass of the aqueous ink.

The particle size distribution of the resin particles is not particularly limited, and may be wide particle size distribution or monodisperse particle size distribution. Furthermore, two or more kinds of resin particles having monodisperse particle size distribution may be used by being mixed together.

(Surfactant)

The aqueous ink used in the present invention may contain a surfactant as a surface tension adjuster.

As the surfactant, it is possible to use any of an anionic surfactant, a cationic surfactant, an amphoteric surfactant, a nonionic surfactant, and a betaine-based surfactant.

Specific examples of the anionic surfactant include sodium dodecylbenzenesulfonate, sodium lauryl sulfate, sodium alkyl diphenyl ether disulfonate, sodium alkyl naphthalene sulfonate, sodium dialkyl sulfosuccinate, sodium stearate, potassium oleate, sodium dioctylsulfosuccinate, sodium polyoxyethylene alkyl ether sulfate, sodium polyoxyethylene alkyl ether sulfate, sodium polyoxyethylene alkyl phenyl ether sulfate, sodium dialkyl sulfosuccinate, sodium stearate, sodium oleate, a sodium t-octylphenoxyethoxypolyethoxyethyl sulfate salt, and the like. One kind of surfactant or two or more kinds of surfactants can be selected from these.

Specific examples of the nonionic surfactant include acetylene diol derivatives such as an ethylene oxide adduct of acetylene diol, polyoxyethylene lauryl ether, polyoxyethylene octylphenyl ether, polyoxyethylene oleyl phenyl ether, polyoxyethylene nonylphenyl ether, oxyethylene-oxypropylene block copolymer, t-octyl phenoxyethyl polyethoxy ethanol, nonyl phenoxyethyl polyethoxy ethanol, and the like. One kind of surfactant or two or more kinds of surfactants can be selected from these.

Examples of the cationic surfactant include a tetraalkyl ammonium salt, an alkyl amine salt, a benzalkonium salt, an alkylpyridium salt, an imidazolium salt, and the like. Specific examples thereof include dihydroxy ethyl stearylamine, 2-heptadecenyl-hydroxyethyl imidazoline, lauryl dimethyl benzyl ammonium chloride, cetylpyridinium chloride, stearamide methyl pyridium chloride, and the like.

Among these surfactants, from the viewpoint of the stability, a nonionic surfactant is preferable, and an acetylene diol derivative is more preferable.

In a case where the aqueous ink used in the present invention is used in an ink jet recording method, from the viewpoint of jetting properties of the ink, the amount of the surfactant is preferably adjusted such that the surface tension of the aqueous ink becomes 20 to 60 mN/m, more preferably adjusted such that the surface tension becomes 20 to 45 mN/m, and more preferably adjusted such that the surface tension becomes 25 to 40 mN/m.

The surface tension of the aqueous ink is measured by using an Automatic Surface Tensiometer CBVP-Z (manufactured by Kyowa Interface Science Co., LTD.) at 25° C.

The content of the surfactant in the aqueous ink is preferably an amount that enables the surface tension of the aqueous ink to fall into the aforementioned range. More specifically, the content of the surfactant in the aqueous ink is preferably equal to or greater than 0.1% by mass, more preferably 0.1% to 10% by mass, and even more preferably 0.2% to 3% by mass.

(Other Components)

If necessary, the aqueous ink used in the present invention may be mixed with additives such as a dehydration inhibitor (swelling agent), a desiccant, a coloration inhibitor, a penetration enhancer, an ultraviolet absorber, a preservative, a rust inhibitor, an anti-foaming agent, a viscosity adjuster, a pH adjuster, and a chelating agent. The mixing method is not particularly limited, and by appropriately selecting a generally used mixing method, the aqueous ink can be obtained.

(Physical Properties of Aqueous Ink)

The viscosity at 25° C. of the aqueous ink used in the present invention is preferably equal to or greater than 1.2 mPa·s and equal to or smaller than 15.0 mPa·s, more preferably equal to or greater than 2 mPa·s and less than 13 mPa·s, and even more preferably equal to or greater than 2.5 mPa·s and less than 10 mPa·s.

The viscosity of the aqueous ink is measured by using a VISCOMETER TV-22 (manufactured by TOKI SANGYO CO., LTD.) at 25° C.

From the viewpoint of the dispersion stability at 25° C., the pH of the aqueous ink used in the present invention is preferably 6 to 11, more preferably 7 to 10, and even more preferably 7 to 9.

—Image Formation—

By coating the aggregation-inducing layer with the aqueous ink, an intended image can be formed. In the present invention, the aqueous ink is jetted onto the aggregation-inducing layer by an ink jet method.

As the recording method using the ink jet method preferable in the present invention, it is possible to adopt the method described in paragraphs "0093" to "0105" of JP2003-306623A. Hereinafter, the ink jet method will be more specifically described.

(Ink Jet Method)

The ink jet method used for image recording of the present invention is not particularly limited, and a commonly used method can be adopted. For example, the ink jet method may be any of an electric charge control method in which an ink is jetted by using electrostatic attraction force; a drop-on-demand method (a pressure pulse method) using vibration pressure of a piezoelectric element; an acoustic ink jet method in which an ink is irradiated with an acoustic beam converted from an electric signal and the ink is jetted by using the radiation pressure; and a thermal ink jet method in which air bubbles are formed by heating an ink and the thus generated pressure is used; and the like.

Furthermore, an ink jet head used in the ink jet method may be an on-demand type or a continuous type. In addition, an ink nozzle or the like used at the time of performing recording by the ink jet method is not particularly limited, and can be appropriately selected according to the purpose.

The ink jet method includes a method of jetting a large number of low-concentration inks called photo inks in a small volume, a method of improving image quality by using a plurality of inks which have substantially the same color but different densities, and a method of using a colorless and transparent ink.

The ink jet method also includes a shuttle method of using a short serial head, in which recording is performed while a recording medium is being scanned in a width direction by the head, and a line method of using a line head in which recording elements are arranged to correspond to the entire region of one side of a recording medium. In the line method, the recording medium is scanned in a direction orthogonal to the arrangement direction of the recording elements, and accordingly, an image can be recorded on the entire surface of the recording medium, and a transport system such as a carriage scanning the short head is not required. Moreover, complicated scanning control for moving a carriage and a recording medium is not required, and only the recording medium is moved. Therefore, the recording speed in the line method can be increased to more than that in the shuttle method.

In a case where an ink applying step is performed by the ink jet method, from the viewpoint of forming a high-definition print, the amount of the aqueous ink droplets jetted by the ink jet method is preferably 1.5 to 3.0 pL, and more preferably 1.5 to 2.5 pL. The amount of the aqueous ink droplets jetted can be regulated by appropriately adjusting the jetting conditions.

(Ink Drying Step)

If necessary, the step (b) may include an ink drying step of drying and removing a solvent (for example, water or the aforementioned aqueous medium) in the aqueous ink applied onto the aggregation-inducing layer. The ink drying step is not particularly limited as long as at least a portion of the solvent of the ink can be removed, and a generally used method can be adopted.

(Thermal Fixing Step)

If necessary, the step (b) preferably includes a thermal fixing step after the ink drying step. By performing the thermal fixing treatment, the image on the recording medium can be fixed, and the scratch resistance of the image can be further improved. As the thermal fixing step, for example, it is possible to adopt the thermal fixing step described in paragraphs "0112" to "0120" in JP2010-221415A.

(Ink Removing Step)

If necessary, the ink jet recording method of the present invention may include an ink removing step of removing the aqueous ink (such as solids of the ink solidified by drying) having adhered to the ink jet recording head by using a maintenance liquid. Specifically, as the maintenance liquid and the ink removing step, the maintenance liquid and the ink removing step described in WO2013/180074A can be preferably adopted.

EXAMPLES

Hereinafter, the present invention will be more specifically described based on examples, but the present invention is not limited to the examples. Herein, unless otherwise specified, "part" and "%" showing the composition are based on mass.

Description of Abbreviations and Trade Names Used in Present Example

MMA: methyl methacrylate (manufactured by Wako Pure Chemical Industries, Ltd.)

nBuMA: normal butyl methacrylate (manufactured by Wako Pure Chemical Industries, Ltd.)

iBuMA: isobutyl methacrylate (manufactured by Wako Pure Chemical Industries, Ltd.)

tBuMA: t-butyl methacrylate (manufactured by Wako Pure Chemical Industries, Ltd.)

BnMA: benzyl methacrylate (manufactured by Wako Pure Chemical Industries, Ltd.)

2EHMA: 2-ethylhexyl methacrylate (manufactured by Wako Pure Chemical Industries, Ltd.)

2EHA: 2-ethylhexyl methacrylate (manufactured by Wako Pure Chemical Industries, Ltd.)

iC10MA: isodecyl methacrylate (manufactured by Sigma-Aldrich Co. LLC.)

C12MA: dodecyl methacrylate (manufactured by Wako Pure Chemical Industries, Ltd.)

C18MA: stearyl methacrylate (manufactured by Wako Pure Chemical Industries, Ltd.)

C24MA: synthetic monomer (synthesized from methacrylic acid chloride and 1-tetracosanol with reference to Experimental Chemistry Course, $4^{th}$ edition, vol, 28, Polymer synthesis)

IBOMA: isobornyl methacrylate (manufactured by Wako Pure Chemical Industries, Ltd.)

PhMA: phenyl methacrylate (manufactured by TOKYO CHEMICAL INDUSTRY CO., LTD.)

AMPS: 2-acrylamide-2-methylpropane sulfonic acid (manufactured by TOKYO CHEMICAL INDUSTRY CO., LTD.)

PHOSMER M: 2-(methacryloyloxy)ethyl phosphate (synonym: 2-methacryloyloxyethyl acid phosphate, manufactured by Uni-Chemical Co., Ltd.)

V-601: dimethyl 2,2-azobis(2-methylpropionate) (manufactured by Wako Pure Chemical Industries, Ltd.)

Anti-foaming agent: TSA-739 (solid content: 15%), emulsion-type silicone anti-foaming agent SUNNIX GP-250: organic solvent manufactured by Sanyo Chemical Industries, Ltd.

OLFINE E1010: nonionic surfactant manufactured by Nissin Chemical Co., Ltd.

MD 1200: water-dispersion type copolymerized polyester resin having high molecular weight (manufactured by Toyobo Co., Ltd)

OK TOPCOAT+: coated paper (manufactured by Oji Paper Co., Ltd.)

OK KINFUJI+: coated paper (manufactured by Oji Paper Co., Ltd.)

OK COAT L: coated paper (manufactured by Oji Paper Co., Ltd.)

AURORA COAT: coated paper (manufactured by NIPPON PAPER INDUSTRIES CO., LTD.)

SHIRAOI: uncoated paper (manufactured by NIPPON PAPER INDUSTRIES CO., LTD.)

[Preparation of Fine Resin Particles A-1]

A 500 mL three-neck flask equipped with a stirrer, a thermometer, a reflux condenser pipe, and a nitrogen gas introduction pipe was filled with methyl ethyl ketone (50.5 g) and 2-propanol (21.6 g) and heated to 85° C. In a state where reflux was being performed in the reaction container (hereinafter, reflux was continued until the reaction was finished), a mixed solution formed of 2-ethylhexyl methacrylate (90.0 g), PHOSMER M (10.0 g), methyl ethyl ketone (27.8 g), 2-propanol (40.0 g), water (10.0 g), and V-601 (1.97 g) was added dropwise thereto at a constant speed such that the dropwise addition was finished within 4 hours. After the dropwise addition was finished, the reaction solution was stirred for 1 hour, and then a solution formed of V-601 (1.1 g) and methyl ethyl ketone (4.9 g) was added thereto, followed by stirring for 2 hours. Thereafter, a solution formed of V-601 (1.1 g) and methyl ethyl ketone (4.9 g) was added thereto, and the reaction solution was stirred for 2 hours.

The obtained copolymer had a weight-average molecular weight (Mw) of 32,000.

Mw was measured by GPC by using HLC-8220GPC (manufactured by Tosoh Corporation). Three columns of TSKgel Super HZM-H, TSKgel Super HZ4000, and TSKgel Super HZ200 were connected in series, and N-methylpyrrolidone (NMP) was used as an eluent. A sample concentration was set to be 0.2% by mass, a flow rate was set to be 0.35 ml/min, a sample injection amount was set to be 60 μl, and a measurement temperature was set to be 40° C. As a detector, an IR detector was used. A calibration curve was prepared from six samples of "standard sample TSK standard, polystyrene" manufactured by Tosoh Corporation: "F-80", "F-20", "F-4", F-1", A-2500", and "A-500".

—Phase Transfer Step—

Then, methyl ethyl ketone (12.0 g), 2-propanol (7.5 g), a 20% aqueous maleic acid solution (0.22 g, water-soluble electrolyte, equivalent to 0.13% with respect to the copolymer), and a 1.85 mol/L aqueous NaOH solution (8.21 g) were added to the obtained copolymer solution (97.2 g, concentration of solid contents: 36.0%), and the internal temperature of the reaction container was increased to 70° C. Thereafter, 104 g of distilled water was added dropwise thereto at a constant speed of 5 ml/min such that the copolymer was dispersed in water (dispersion step). Subsequently, the internal pressure of the reaction container was reduced, and isopropanol, methyl ethyl ketone, and distilled water were distilled away (solvent removing step), thereby obtaining an aqueous dispersion of fine resin particles (A-1) having a concentration of solid contents of 23.2%. The numerical values in the following table showing the proportion of each constitutional unit is based on mass.

[Preparation of Fine Resin Particles A-2 to A-24 and B-1 to B-6]

Aqueous dispersions of fine resin particles A-2 to A-24 and B-1 to B-6 (the concentration of the solid content was 23.2% in all of the dispersions) were prepared in the same manner as in [Preparation of fine resin particles A-1] described above, except that the type and amount of the monomer used were changed as shown in the following table. All of the fine resin particles A-1 to A-24 had a solubility within a range of 0.5 to 1.6 g with respect to 100 g of water (25° C.) and were water-insoluble.

[Coating of Fine Resin Particles]

An aqueous dispersion of fine resin particles composed as below was prepared.

<Aqueous Dispersion of Fine Resin Particles>

| | |
|---|---|
| Diethylene glycol monoethyl ether | 4% |
| Tripropylene glycol monomethyl ether | 4% |
| Malonic acid | 17.3% |
| Propane tricarboxylic acid | 4.3% |
| Phosphoric acid | 4.3% |
| Dispersion of fine resin particles prepared as above (solid content: 23.2%) | 17.2% |
| Benzotriazole | 1% |
| Anti-foaming agent | 100 ppm as amount of silicone oil |
| Deionized water | amount yielding 100% in total |

The obtained aqueous dispersions of fine resin particles had pH within a range of 1.5 to 2.1 at 25° C. and viscosity within a range of 2.4 to 13.4 mPa·s at 25° C.

By using a bar coater, the entire surface of the paper medium shown in the following table was coated with each of the aqueous dispersions of fine resin particles prepared as above, such that the coating amount of the fine resin particles became as shown in the following table. Then, the paper medium was dried for 5 seconds at 80° C. In a case where the paper medium had a coating layer, the coating layer was coated with each of the aqueous dispersions of fine resin particles.

The paper medium surface having undergone coating and drying (hereinafter, referred to as "coated surface") was observed using a scanning electron microscope (SEM). As a result, it was found that the resin existed in the form of a uniform film on the surface (that is, the fine resin particles are integrated by being fused with each other).

[Preparation of Aqueous Ink]

<Synthesis of Polymer Dispersant P-1>

A polymer dispersant P-1 was synthesized as below.

Methyl ethyl ketone (88 g) was put into a 1,000 ml three-neck flask equipped with a stirrer and a cooling pipe and heated to 72° C. in a nitrogen atmosphere. To the resultant, a solution, which was obtained by dissolving dimethyl 2,2'-azobisisobutyrate (0.85 g), benzyl methacrylate (60 g), methacrylic acid (10 g), and methyl methacrylate (30 g) in methyl ethyl ketone (50 g), was added dropwise for 3 hours. After the dropwise addition was finished, the resultant was further reacted for 1 hour, a solution, which was obtained by dissolving dimethyl 2,2'-azobisisobutyrate (0.42 g) in methyl ethyl ketone (2 g), was added thereto, and the resultant was heated to 78° C. for 4 hours. The obtained reaction solution was reprecipitated twice in a large excess of hexane, and the precipitated resin was dried, thereby obtaining 96 g of a polymer dispersant P-1.

The composition of the obtained polymer dispersant was checked by $^{1}$H-NMR. The polymer dispersant had a weight-average molecular weight of 44,600. Furthermore, as a result of measuring an acid value thereof by the method described in JIS standard (JIS K 0070:1992), an acid value of 1.16 mgKOH/g was obtained.

<Preparation of Pigment Dispersion>

(Preparation of Cyan Dispersion)

10 parts of Pigment Blue 15:3 (phthalocyanine blue A220, manufactured by Dainichiseika Color & Chemicals Mfg. Co., Ltd.) as a cyan pigment, 5 parts of the polymer dispersant P-1, 42 parts of methyl ethyl ketone, 5.5 parts of an 1N aqueous NaOH solution, and 87.2 parts of deionized water were mixed together and dispersed for 2 to 6 hours by a beads mill using 0.1 mmϕ zirconia beads.

From the obtained dispersion, methyl ethyl ketone was removed under reduced pressure at 55° C., and then a portion of water was removed. Furthermore, by using a high-speed refrigerated centrifuge 7550 (manufactured by KUBOTA CORPORATION) and a 50 mL centrifuge tube, the dispersion was subjected to a centrifugation treatment for 30 minutes at 8,000 rpm, and the supernatant liquid other than the precipitate was collected.

Then, the pigment concentration was determined from the absorbance spectrum, thereby obtaining a dispersion (cyan dispersion C) of resin-coated pigment particles (pigment coated with the polymer dispersant) having a pigment concentration of 10.2% by mass. The volume average particle size of the pigment particles of the obtained cyan dispersion C was 105 nm.

The volume average particle size was measured by a dynamic light scattering method by using a nanotrac particle size distribution measurement apparatus UPA-EX150 (manufactured by NIKKISO CO., LTD.).

(Preparation of Magenta Dispersion)

A dispersion (magenta dispersion M) of the resin-coated pigment particles (pigment coated with the polymer dispersant) was prepared in the same manner as in Preparation of cyan dispersion, except that in Preparation of cyan dispersion, Pigment Red 122 as a magenta pigment was used instead of Pigment Blue 15:3 (phthalocyanine blue A220, manufactured by Dainichiseika Color & Chemicals Mfg. Co., Ltd). The volume average particle size of the pigment particles of the obtained magenta dispersion M was 85 nm.

(Preparation of Yellow Dispersion)

A dispersion (yellow dispersion Y) of the resin-coated pigment particles (pigment coated with the polymer dispersant) was prepared in the same manner as in Preparation of cyan dispersion, except that in Preparation of cyan dispersion, Pigment Yellow 74 as a yellow pigment was used instead of Pigment Blue 15:3 (phthalocyanine blue A220, manufactured by Dainichiseika Color & Chemicals Mfg. Co., Ltd). The volume average particle size of the pigment particles of the obtained yellow dispersion Y was 82 nm.

(Preparation of Black Dispersion)

A dispersion (black dispersion K) of resin-coated pigment particles (pigment coated with the polymer dispersant) was prepared in the same manner as in the preparation of the cyan dispersion, except that in the preparation of the cyan dispersion, carbon black (NIPEX 160-IQ manufactured by Evonik Degussa Co., Ltd.) as a black pigment was used instead of Pigment Blue 15:3 (phthalocyanine blue A220, manufactured by Dainichiseika Color & Chemicals Mfg Co., Ltd.). The volume average particle size of the pigment particles of the obtained black dispersion K was 130 nm.

<Preparation of Self-Dispersing Resin Particles D-01>

A 2 L three-neck flask equipped with a stirrer, a thermometer, a reflux condenser pipe, and a nitrogen gas introduction pipe was filled with methyl ethyl ketone (360.0 g) and heated to 75° C. In a state where the internal temperature of the reaction container was kept at 75° C., a mixed solution formed of phenoxyethyl acrylate (180.0 g), methyl methacrylate (162.0 g), acrylic acid (18.0 g), methyl ethyl ketone (72 g), and "V-601" (manufactured by Wako Pure Chemical Industries, Ltd.) (1.44 g) was added dropwise thereto at a constant speed such that the dropwise addition was finished in 2 hours. After the dropwise addition was finished, a solution formed of "V-601" (0.72 g) and methyl ethyl ketone (36.0 g) was added thereto, and the resultant was stirred for 2 hours at 75° C. Then a solution formed of "V-601" (0.72 g) and isopropanol (36.0 g) was added thereto, and the resultant was stirred for 2 hours at 75° C. Thereafter, the resultant was heated to 85° C. and continuously stirred for two more hours. The obtained copolymer had a weight-average molecular weight of 64,000 and an acid value of 0.69 mmol/g.

Subsequently, the copolymer solution (668.3 g) was weighed out, isopropanol (388.3 g) and a 1 mol/L aqueous NaOH solution (145.7 ml) were added thereto, and the internal temperature of the reaction container was raised to 80° C. Then, distilled water (720.1 g) was added dropwise thereto at a rate of 20 ml/min such that the polymer was dispersed in water. Thereafter, under the atmospheric pressure, the resultant was kept for 2 hours at an internal temperature of the reaction container of 80° C., then for 2 hours at an internal temperature of the reaction container of 85° C., and for 2 hours at an internal temperature of the reaction container of 90° C. Thereafter, the internal pressure of the reaction container was reduced, and a total of 913.7 g of isopropanol, methyl ethyl ketone, and distilled water were distilled away, thereby obtaining an aqueous dispersion (emulsion) of self-dispersing resin particles (D-01) having a concentration of solid contents of 28.0%.

<Preparation of Ink>

Each of the pigment dispersions (the cyan dispersion C, the magenta dispersion M, the yellow dispersion Y, and the black dispersion K) and the aqueous dispersion of the self-dispersing resin particles D-01 obtained as above were mixed together such that the composition (unit: % by mass) of an ink shown in the following table was obtained, thereby preparing each ink composition (a magenta ink M, a black ink K, a cyan ink C, and a yellow ink Y).

Each of the prepared ink compositions was filtered through a PVDF 5 μm filter (Millex SV manufactured by Merck Millipore, diameter: 25 mm) by using a plastic disposable syringe, thereby obtaining finished inks (a magenta ink M, a black ink K, a cyan ink C, and a yellow ink Y).

TABLE 1

| | Magenta ink M | Black ink K | Cyan ink C | Yellow ink Y |
|---|---|---|---|---|
| Magenta dispersion M | 4 | | | |
| Black dispersion K | | 4 | | |
| Cyan dispersion C | | | 4 | |
| Yellow dispersion Y | | | | 4 |
| Polymer dispersant P-1 | 2 | 2 | 2 | 2 |
| SUNNIX GP-250 | 10 | 10 | 10 | 10 |
| Tripropylene glycol monomethyl ether | 5 | 5 | 5 | 5 |
| OLFINE E1010 | 1 | 1 | 1 | 1 |
| Aqueous dispersion of D-01 | 8 | 8 | 8 | 8 |
| Water | 70 | 70 | 70 | 70 |
| pH of ink | 8.5 | 8.6 | 8.5 | 8.5 |
| Surface tension of ink (mN/m) | 34.8 | 35.2 | 35.0 | 35.1 |

Test Example

<Evaluation of Dispersibility of Fine Resin Particles>

For the aqueous dispersions of the fine resin particles A-1 to A-24 and B-1 to B-6 prepared as above, by using a TV-22-type viscometer (manufactured by TOKI SANGYO CO., LTD.), the viscosity (unit: cP) of each of the aqueous dispersions was measured at 25° C. within 1 hour after the dispersions were prepared. The measured value was taken as initial viscosity of each of the aqueous dispersions.

Furthermore, the aqueous dispersions of the fine resin particles A-1 to A-24 and B-1 to B-6 prepared as above were stored for 24 hours at 50° C., and then the viscosity thereof was measured in the same manner. The measured viscosity of each of the dispersions was taken as post-storage viscosity of each of the aqueous dispersions.

A rate of change in viscosity of each of the aqueous dispersions was determined based on the following equation.

Rate of change in viscosity (%)=100×(post-storage viscosity−initial viscosity)/initial viscosity By applying the obtained rate of change in viscosity to the following evaluation standards, the dispersibility was evaluated. The results are shown in the following table.

—Dispersibility Evaluation Standards—

A: The rate of change in viscosity was equal to or lower than 10%.

B: The rate of change in viscosity was higher than 10% and equal to or lower than 15%.

C: The rate of change in viscosity was higher than 15% and equal to or lower than 25%.

D: The rate of change in viscosity was higher than 25% and equal to or lower than 50%.

E: The rate of change in viscosity was higher than 50%.

[Evaluation of Cockling]

A GELJET GX5000 printer head manufactured by RICOH JAPAN Corp. was prepared. This printer head is a line head in which 96 nozzles are lined up. The printer head was fixed and disposed into an ink jet recording device having a structure described in FIG. 1 of JP2013-223960A.

At this time, the printer head was disposed such that the direction in which the 96 nozzles are lined up tilted by 75.7° with respect to the direction orthogonal to the movement direction of a stage of the ink jet recording device on the same plane.

In the following method, the ink droplets started to be jetted onto the coated surface of the image recording paper medium.

(Jetting Method)

In a state where the image recording paper medium was being moved at a constant speed in the movement direction of the stage, each of the black ink K, the cyan ink C, the magenta ink M and the yellow ink Y prepared as above was jetted from the printer head in a line method under the jetting conditions of an amount of ink droplet of 1.2 pL, an jetting frequency of 24 kHz, and resolution of 1200 dpi×1200 dpi (dot per inch) and a stage speed of 50 mm/s, so as to print a solid image in which dots of the respective colors were superposed on each other. More specifically, by forming a single-pass image of four colors on the central portion of the coated surface of the image recording paper medium under the aforementioned conditions, a 100% solid black image (2 cm×10 cm) was printed.

Immediately after printing, the image was dried for 3 seconds at a temperature of 60° C. and then subjected to a fixing treatment at a nip pressure of 0.25 MPa and a nip width of 4 mm by being passed between a pair of fixing rollers heated to 60° C.

Thereafter, the cockling occurring immediately after printing was evaluated.

—Evaluation of Deformation of Image Recording Paper Medium—

The image formed as above was visually observed, and the state of cockling occurred was evaluated according to the following evaluation standards. Among the following evaluation scales, A and B are levels that are unproblematic for practical use.

A: Cockling did not occur in the entirety of the image forming portion.

B: Slight cockling occurred in a portion of the image forming portion.

C: Cockling occurred in an area that was approximately half of the image forming portion.

D: Cockling occurred over a wider range of the image forming portion.

E: Cockling occurred in the entire image forming portion.

The results are shown in the following table.

<Evaluation of Degree of Gloss>

A GELJET GX5000 printer head (manufactured by RICOH JAPAN Corp.) was prepared, and a storage tank connected thereto was refilled with the black ink K prepared as above. The printer head was fixed and disposed into the ink jet recording device having the structure described in FIG. 1 of JP2013-223960A.

Specifically, the GELJET GX5000 printer head was fixed and disposed such that the direction (main scanning direction) of the line head, in which nozzles were lined up, tilted by 75.7° with respect to the direction orthogonal to the movement direction (sub-scanning direction) of the stage. Thereafter, in a state where the image recording paper medium was being moved at a constant speed in the sub-scanning direction, the ink was jetted onto the coated surface in a line method under the jetting conditions of an amount of ink droplets of 2.4 pL, a jetting frequency of 24 kHz, and resolution of 1,200 dpi×1,200 dpi. In this way, a 100% solid black image was printed on the entire coated surface.

Immediately after printing, the image was dried for 3 seconds at a temperature of 60° C. and subjected to a fixing treatment at a nip pressure of 0.25 MPa and a nip width of 4 mm by being passed between a pair of fixing rollers heated to 60° C.

By using a gloss meter IG-410 (manufactured by HORIBA, LTD.), the obtained image was evaluated in terms of a degree of gloss at an angle of 60° specified in JIS K5600. Specifically, based on a difference in a degree of gloss (difference of a degree of gloss) between the image obtained as above and a solid image obtained in the same manner as described above by using a paper medium not being coated with the aqueous dispersion of fine resin particles (that is, a commercial paper medium that was used as the raw material of a paper medium used as a test sample), the degree of gloss was evaluated based on the following evaluation standards. Herein, in a case where the image recording paper medium coated with the aqueous dispersion of fine resin particles was used, the degree of gloss was the same as or higher than the degree of gloss obtained in a case where a paper medium not being coated with the aqueous dispersion of fine resin particles was used.

—Evaluation of Degree of Gloss—

A: The difference of a degree of gloss was less than 1.

B: The difference of a degree of gloss was equal to or greater than 1 and less than 3.

C: The difference of a degree of gloss was equal to or greater than 3 and less than 5.

D: The difference of a degree of gloss was equal to or greater than 5 and less than 10.

E: The difference of a degree of gloss was equal to or greater than 10.

The results are shown in the following table.

TABLE 2

| | Fine resin particles | Volume average particle size μm | Mw | Type: Monomer 1 | Type: Monomer 2 | Type: Monomer 3 | Type: Monomer 4 | Composition (%): Monomer 1 | Composition (%): Monomer 2 | Composition (%): Monomer 3 | Composition (%): Monomer 4 | Y/X | Y/Z | Paper medium (raw material) | Coating amount of fine resin particles ($g/m^2$) | Dispersibility | Cockling | Degree of gloss |
|---|---|---|---|---|---|---|---|---|---|---|---|---|---|---|---|---|---|---|
| Example 1 | A-1 | 0.145 | 32,000 | 2EHMA | PHOSMER M | | | 90 | 10 | | | 9.0 | | OK TOPCOAT+ | 0.9 | B | A | A |
| Example 2 | A-2 | 0.189 | 48,000 | 2EHMA | MMA | PHOSMER M | | 70 | 20 | 10 | | 7.0 | | OK TOPCOAT+ | 0.9 | B | A | A |
| Example 3 | A-3 | 0.204 | 89,000 | 2EHMA | MMA | PHOSMER M | | 50 | 40 | 10 | | 5.0 | | OK TOPCOAT+ | 0.9 | B | A | A |
| Example 4 | A-4 | 0.213 | 167,000 | 2EHMA | MMA | PHOSMER M | | 30 | 60 | 10 | | 3.0 | | OK TOPCOAT+ | 0.9 | B | B | A |
| Example 5 | A-4 | 0.213 | 167,000 | 2EHMA | MMA | PHOSMER M | | 30 | 60 | 10 | | 3.0 | | OK TOPCOAT+ | 0.5 | B | B | A |
| Example 6 | A-4 | 0.213 | 167,000 | 2EHMA | MMA | PHOSMER M | | 30 | 60 | 10 | | 3.0 | | OK TOPCOAT+ | 1.8 | B | A | A |
| Example 7 | A-4 | 0.213 | 167,000 | 2EHMA | MMA | PHOSMER M | | 30 | 60 | 10 | | 3.0 | | OK TOPCOAT+ | 2.6 | B | A | A |
| Example 8 | A-4 | 0.213 | 167,000 | 2EHMA | MMA | PHOSMER M | | 30 | 60 | 10 | | 3.0 | | OK TOPCOAT+ | 4.4 | B | A | B |
| Example 9 | A-5 | 0.245 | 28,000 | 2EHMA | PHOSMER M | | | 95 | 5 | | | 19.0 | | OK TOPCOAT+ | 0.9 | B | B | A |
| Example 10 | A-6 | 0.196 | 45,000 | 2EHMA | PHOSMER M | | | 80 | 20 | | | 4.0 | | OK TOPCOAT+ | 0.9 | B | A | A |
| Example 11 | A-7 | 0.132 | 64,000 | 2EHMA | PHOSMER M | | | 70 | 30 | | | 2.3 | | OK TOPCOAT+ | 0.9 | B | A | B |
| Example 12 | A-8 | 0.211 | 24,000 | 2EHMA | Vinylphosphonic acid | | | 90 | 10 | | | 9.0 | | OK TOPCOAT+ | 0.9 | B | A | A |
| Example 13 | A-9 | 0.126 | 35,000 | 2EHMA | PHOSMER M | AMPS | | 90 | 5 | 5 | | 18.0 | 18.0 | OK TOPCOAT+ | 0.9 | B | B | A |
| Example 14 | A-10 | 0.061 | 35,000 | 2EHMA | PHOSMER M | AMPS | | 81 | 9 | 10 | | 9.0 | 8.1 | OK TOPCOAT+ | 0.9 | A | A | A |
| Example 15 | A-10 | 0.061 | 35,000 | 2EHMA | PHOSMER M | AMPS | | 81 | 9 | 10 | | 9.0 | 8.1 | OK KINFUJI+ | 0.9 | A | A | A |
| Example 16 | A-10 | 0.061 | 35,000 | 2EHMA | PHOSMER M | AMPS | | 81 | 9 | 10 | | 9.0 | 8.1 | OK COAT L | 0.9 | A | A | A |
| Example 17 | A-10 | 0.061 | 35,000 | 2EHMA | PHOSMER M | AMPS | | 81 | 9 | 10 | | 9.0 | 8.1 | AURORA COAT | 0.9 | A | A | A |
| Example 18 | A-10 | 0.061 | 35,000 | 2EHMA | PHOSMER M | AMPS | | 81 | 9 | 10 | | 9.0 | 8.1 | SHIRAOI | 0.9 | A | B | A |
| Example 19 | A-11 | 0.108 | 53,000 | iBuMA | PHOSMER M | AMPS | | 81 | 9 | 10 | | 9.0 | 8.1 | OK TOPCOAT+ | 0.9 | A | A | A |

TABLE 2-continued

| | | | | | | | | | | | | | | | | | | |
|---|---|---|---|---|---|---|---|---|---|---|---|---|---|---|---|---|---|---|
| Example 20 | A-12 | 0.141 | 34,000 | iC10MA | PHOSMER M | AMPS | | 81 | 9 | 10 | | 9.0 | 8.1 | OK TOPCOAT+ | 0.9 | A | A | A |
| Example 21 | A-13 | 0.172 | 48,000 | C12MA | PHOSMER M | AMPS | | 81 | 9 | 10 | | 9.0 | 8.1 | OK TOPCOAT+ | 0.9 | A | A | A |
| Example 22 | A-14 | 0.193 | 45,000 | C18MA | PHOSMER M | AMPS | | 81 | 9 | 10 | | 9.0 | 8.1 | OK TOPCOAT+ | 0.9 | A | A | A |
| Example 23 | A-15 | 0.221 | 51,000 | C24MA | PHOSMER M | AMPS | | 81 | 9 | 10 | | 9.0 | 8.1 | OK TOPCOAT+ | 0.9 | B | A | B |
| Example 24 | A-16 | 0.122 | 33,000 | BnMA | PHOSMER M | AMPS | | 81 | 9 | 10 | | 9.0 | 8.1 | OK TOPCOAT+ | 0.9 | A | B | A |
| Example 25 | A-17 | 0.165 | 28,000 | 2EHMA | Vinylphosphonic acid | AMPS | | 81 | 9 | 10 | | 9.0 | 8.1 | OK TOPCOAT+ | 0.9 | A | A | A |
| Example 26 | A-18 | 0.121 | 72,000 | iC10MA | PHOSMER M | AMPS | | 60 | 30 | 10 | | 2.0 | 6.0 | OK TOPCOAT+ | 0.9 | A | A | B |
| Example 27 | A-19 | 0.090 | 18,000 | iC10MA | PHOSMER M | AMPS | | 80 | 4 | 16 | | 20.0 | 5.0 | OK TOPCOAT+ | 0.9 | A | B | A |
| Example 28 | A-20 | 0.079 | 44,000 | iC10MA | PHOSMER M | AMPS | | 60 | 20 | 20 | | 3.0 | 20.0 | OK TOPCOAT+ | 0.9 | B | A | A |
| Example 29 | A-21 | 0.162 | 38,000 | iC10MA | PHOSMER M | AMPS | | 80 | 16 | 4 | | 5.0 | 4.0 | OK TOPCOAT+ | 0.9 | B | A | A |
| Example 30 | A-22 | 0.121 | 38,000 | iBuMA | iC10MA | PHOSMER M | AMPS | 40 | 40 | 10 | 10 | 8.0 | 8.0 | OK TOPCOAT+ | 0.9 | A | A | A |
| Example 31 | A-23 | 0.156 | 44,000 | IBOMA | C18MA | PHOSMER M | AMPS | 30 | 50 | 10 | 10 | 8.0 | 8.0 | OK TOPCOAT+ | 0.9 | A | A | A |
| Example 32 | A-24 | 0.121 | 36,000 | PhMA | PHOSMER M | AMPS | | 81 | 9 | 10 | | 9.0 | 8.1 | OK TOPCOAT+ | 0.9 | A | B | A |
| Comparative Example 1 | B-1 | 0.140 | 54,000 | MMA | PHOSMER M | | | 70 | 30 | | | | | OK TOPCOAT+ | 0.9 | A | E | A |
| Comparative Example 2 | B-2 | 0.640 | 189,000 | PHOSMER M | AMPS | | | 70 | 30 | | | | | OK TOPCOAT+ | 0.9 | E | E | C |
| Comparative Example 3 | B-3 | 0.211 | 21,000 | C18MA | nBuMA | AMPS | | 50 | 35 | 15 | | | 5.7 | OK TOPCOAT+ | 0.9 | A | E | A |
| Comparative Example 4 | B-4 | 0.180 | 21,000 | nBuMA | AMPS | | | 90 | 10 | | | | 9.0 | OK TOPCOAT+ | 0.9 | A | D | A |
| Comparative Example 5 | B-5 | 0.455 | 15,000 | iBuMA | PHOSMER M | | | 98 | 2 | | | 49.0 | | OK TOPCOAT+ | 0.9 | E | C | E |
| Comparative Example 6 | MD1200* | | | | | | | | | | | | | OK TOPCOAT+ | 0.9 | A | C | A |
| Comparative Example 7 | B-6 | 0.200 | 16,000 | MMA | 2EHA | PHOSMER M | AMPS | 85 | 6 | 4 | 4 | | | OK TOPCOAT+ | 0.9 | A | D | C |

*Polyester latex manufac ured by Toyobo Co., Ltd

As shown in Table 2, in a case where the resin did not have the constitutional unit represented by General Formula (1), even though the resin had the constitutional unit represented by General Formula (2-1), cockling occurred in the entire paper medium at the time of forming an image by using an aqueous ink, and the moisture barrier action was not obtained (Comparative Examples 1 and 2).

In a case where the resin did not have a constitutional unit represented by General Formula (2-1) or (2-2), at the time of forming an image by using an aqueous ink, cockling occurred in the entire paper medium or over a wide range of the paper medium, and the moisture barrier action was not sufficiently obtained (Comparative Examples 3 and 4).

In a case where the fine resin particles forming the fine resin particle layer contained the constitutional unit represented by General Formula (1) in an amount larger than the amount specified in the present invention, and the content of the constitutional unit represented by General Formula (2-1) or (2-2) was smaller than the content specified in the present invention, at the time of forming an image by using an aqueous ink, cockling easily occurred, and the difference in a degree of gloss markedly increased (Comparative Example 5). In a case where the content of the constitutional unit represented by General Formula (1) in the fine resin particles was smaller than the content specified in the present invention, at the time of forming an image by using an aqueous ink, cockling that occurred over a wide range was observed as well, and a degree of gloss was easily increased (Comparative Example 7).

In a case where the fine resin particle layer was formed using the commercial water-dispersion type copolymerized polyester resin (MD 1200), at the time of forming an image by using an aqueous ink, cockling easily occurred (Comparative Example 6).

In contrast, in the image recording paper medium containing the resin specified in the present invention, the occurrence of cockling was excellently inhibited at the time of forming an image by using an aqueous ink, and a degree of gloss was excellent. Furthermore, the resin specified in the present invention was water-insoluble and excellently dispersed in water. Accordingly, the resin can be applied onto the paper medium as an aqueous dispersion, and hence the resin can be uniformly incorporated into the surface layer of the paper medium (Examples 1 to 32).

Hitherto, the present invention and the embodiments thereof have been described. The inventors of the present invention consider that, unless otherwise specified, the present invention is not limited to any of the details of the description of the invention and should be broadly interpreted without departing from the gist and scope of the invention shown in the attached claims.

The present application claims a priority based on JP2015-195277 filed on Sep. 30, 2015, the content of which is incorporated into the present specification by reference as a portion of the description of the present specification by reference.

What is claimed is:

1. An image recording paper medium comprising:

a resin having a constitutional unit represented by General Formula (1) and a constitutional unit represented by General Formula (2-1) and/or a constitutional unit represented by General Formula (2-2), wherein in the resin, a content of the constitutional unit represented by General Formula (1) is 30% to 96% by mass, and a total content of the constitutional unit represented by General Formula (2-1) and the constitutional unit represented by General Formula (2-2) is 4% to 70% by mass, General Formula (1)

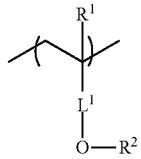

General Formula (2-1)

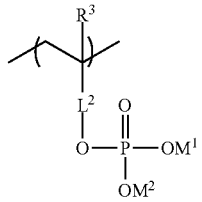

General Formula (2-2)

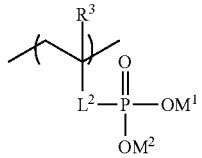

in General Formula (1), $R^1$ represents a hydrogen atom or methyl, $L^1$ represents a divalent linking group having 1 to 5 carbon atoms, and $R^2$ represents an alkyl group having 4 to 24 carbon atoms or an aryl group having 6 to 24 carbon atoms, and in General Formulae (2-1) and (2-2), $R^3$ represents a hydrogen atom or methyl, $L^2$ represents a single bond or a divalent linking group having 1 to 30 carbon atoms, and $M^1$ and $M^2$ each represent a hydrogen ion or a cation, and wherein the resin has a constitutional unit represented by General Formula (3), General Formula (3)

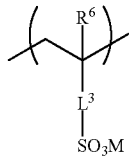

in General Formula (3), $R^6$ represents a hydrogen atom or methyl, $L^3$ represents a divalent linking group, and M represents a hydrogen ion or a cation.

2. The image recording paper medium according to claim 1, wherein in the resin, a ratio of a content Y (% by mass) of the constitutional unit represented by General Formula (1) to a total content X (% by mass) of the constitutional unit represented by General Formula (2-1) and the constitutional unit represented by General Formula (2-2) satisfies $4 \leq Y/X \leq 15$.

3. The image recording paper medium according to claim 1, wherein in the resin, a content of the constitutional unit represented by General Formula (3) is 3% to 20% by mass.

4. The image recording paper medium according to claim 1, wherein in the resin, a ratio of the content Y (% by mass) of the constitutional unit represented by General Formula (1) to a content Z (% by mass) of the constitutional unit represented by General Formula (3) satisfies $5 \leq Y/Z \leq 12$.

5. The image recording paper medium according to claim 1, wherein a content of the resin is 0.006 to 5 g/m$^2$.

6. The image recording paper medium according to claim 1, further comprising:

a coating layer containing calcium carbonate, wherein the resin is contained on the coating layer and/or in the coating layer.

7. A method for manufacturing an image recording paper medium, comprising:

coating a paper medium with a dispersion obtained by dispersing fine resin particles, which are formed of a resin having a constitutional unit represented by General Formula (1) and a constitutional unit represented by General Formula (2-1) and/or a constitutional unit represented by General Formula (2-2), in an aqueous medium, wherein in the resin, a content of the constitutional unit represented by General Formula (1) is 30% to 96% by mass, and a total content of the constitutional unit represented by General Formula (2-1) and the constitutional unit represented by General Formula (2-2) is 4% to 70% by mass, General Formula (1)

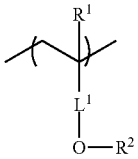

General Formula (2-1)

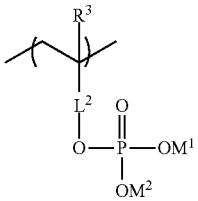

General Formula (2-2)

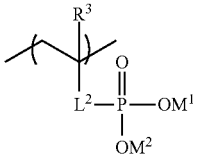

in General Formula (1), $R^1$ represents a hydrogen atom or methyl, $L^1$ represents a divalent linking group having 1 to 5 carbon atoms, and $R^2$ represents an alkyl group having 4 to 24 carbon atoms or an aryl group having 6 to 24 carbon atoms, and in General Formulae (2-1) and (2-2), $R^3$ represents a hydrogen atom or methyl, $L^2$ represents a single bond or a divalent linking group having 1 to 30 carbon atoms, and $M^1$ and $M^2$ each represent a hydrogen ion or a cation, and wherein the resin has a constitutional unit represented by General Formula (3)

General Formula (3)

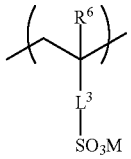

in General Formula (3), $R^6$ represents a hydrogen atom or methyl, $L^3$ represents a divalent linking group, and M represents a hydrogen ion or a cation.

8. The manufacturing method according to claim 7, wherein in the resin, a ratio of the content Y (% by mass) of the constitutional unit represented by General Formula (1) to a total content X (% by mass) of the constitutional unit represented by General Formula (2-1) and the constitutional unit represented by General Formula (2-2) satisfies $4 \leq Y/X \leq 15$.

9. The manufacturing method according to claim 7, wherein in the resin, a content of the constitutional unit represented by General Formula (3) is 3% to 20% by mass.

10. The manufacturing method according to claim 7, wherein in the resin, a ratio of the content Y (% by mass) of the constitutional unit represented by General Formula (1) to a content Z (% by mass) of the constitutional unit represented by General Formula (3) satisfies $5 \leq Y/Z \leq 12$.

11. The manufacturing method according to claim 7, wherein the paper medium has a coating layer containing calcium carbonate, and the coating of the paper medium with the dispersion is coating of the coating layer of the paper medium with the dispersion.

12. The manufacturing method according to claim 7, wherein a volume average particle size of the fine resin particles is 0.001 to 1 μm.

13. An image recording method comprising:

a step of obtaining an image recording paper medium by the manufacturing method according to claim 7; and a step of forming an image by jetting an aqueous ink by using an ink jet method to a surface of the obtained image recording paper medium, the surface being coated with the dispersion.

* * * * *